US006270595B1

(12) United States Patent
Takayama et al.

(10) Patent No.: US 6,270,595 B1
(45) Date of Patent: Aug. 7, 2001

(54) BUSHING FOR CRAWLER BELT AND METHOD OF MANUFACTURE

(75) Inventors: Takemori Takayama; Chigo Okayama; Naoji Hamasaka, all of Hirakata (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/137,845

(22) Filed: Aug. 21, 1998

(30) Foreign Application Priority Data

Aug. 25, 1997 (JP) ..... 9-227876
Oct. 31, 1997 (JP) ..... 9-300636
Feb. 25, 1998 (JP) ..... 10-043903

(51) Int. Cl.[7] ..... C21D 1/18; C21D 9/34; E02F 9/02

(52) U.S. Cl. ..... 148/570; 148/572; 148/575

(58) Field of Search ..... 148/570, 571, 148/572, 575, 590, 594; 266/249, 252; 219/635, 676

(56) References Cited

U.S. PATENT DOCUMENTS 5,049,207 * 9/1991 Sahara et al. ..... 148/150
5,702,667 12/1997 Pond ..... 266/249
6,048,417 * 4/2000 Pond ..... 148/570

FOREIGN PATENT DOCUMENTS 52-34806 9/1977 (JP) .
61-261423 11/1986 (JP) .
63-16314 4/1988 (JP) .
1-37453 8/1989 (JP) .
6-329056 11/1994 (JP) .

* cited by examiner

*Primary Examiner*—Sikyin Ip
(74) *Attorney, Agent, or Firm*—Armstrong, Westerman, Hattori, McLeland & Naughton, LLP

(57) ABSTRACT

Crawler belt bushings and heir producing methods, with which productivity and cost performance can be improved over the carburization treatment and the induction hardening treatment. After a workpiece made from steel is heated from its outer circumferential surface such that at least the surface temperature of the inner circumferential surface of the workpiece is raised to a quenching temperature, a series of quenching operation is performed to form quench hardened layers which extend toward the core from the inner and outer circumferential surfaces respectively and a soft, imperfectly hardened layer between these quench hardened layers. The quenching operation comprises: cooling the workpiece from the inner circumferential surface; cooling the workpiece from the inner circumferential surface while heating from the outer circumferential surface; and cooling the workpiece from the outer circumferential surface.

25 Claims, 35 Drawing Sheets

A REGION: HEATING REGION

B REGION: INNER CIRCUMFERENTIAL SURFACE COOLING + OUTER CIRCUMFERENTIAL SURFACE HEATING COOLING REGION

C REGION: INNER CIRCUMFERENTIAL SURFACE COOLING + OUTER CIRCUMFERENTIAL SURFACE COOLING REGION

FIG.22

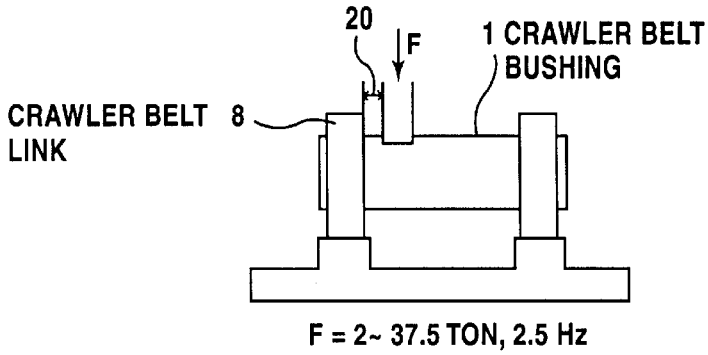

FIG.23

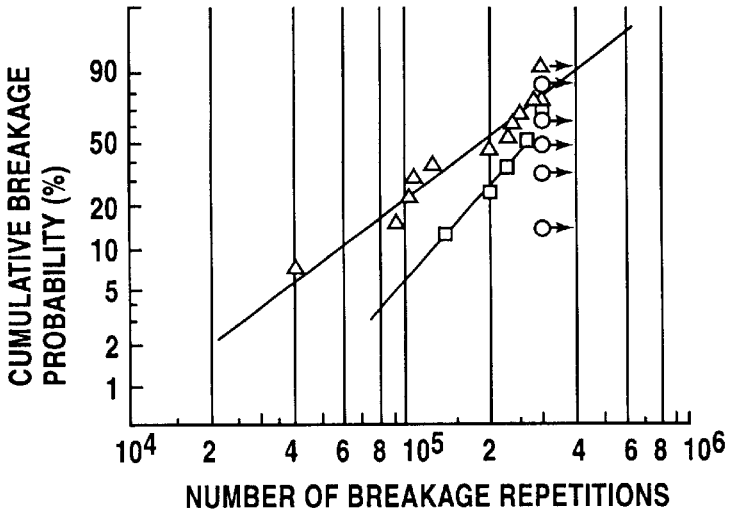

○ ARTICLE OF THE PRESENT INVENTION
(1) HAVING COMPOSITION NO.8
(HARDENED DEPTH OF OUTER CIRCUMFERENTIAL SURFACE 4.5-5.0 mm, HARDENED DEPTH OF INNER CIRCUMFERENTIAL SURFACE 2.5mm)

□ ARTICLE OF THE PRESENT INVENTION
(2) HAVING COMPOSITION NO.7
(HARDENED DEPTH OF OUTER CIRCUMFERENTIAL SURFACE 2.5mm, HARDENED DEPTH OF INNER CIRCUMFERENTIAL SURFACE 2.5mm)

△ CARBURIZATION HARDENED ARTICLE

CARBURIZATION HARDENED BUSHING

INDUCTION QUENCHED BUSHING A

INDUCTION QUENCHED BUSHING B

BUSHING FOR CRAWLER BELT AND METHOD OF MANUFACTURE

TECHNICAL FIELD

The present invention relates to bushings for use in the crawler belts of construction vehicles such as bulldozers and their producing methods. The invention more particularly relates to bushings for crawler belts excellent in wear resistance and impact fatigue resistance and simple methods for producing them at low cost.

BACKGROUND ART

As shown in FIG. 36, a crawler belt 51 for construction vehicles etc. is composed of various parts. A crawler belt bushing 52 meshes with sprocket teeth for transmitting rotating movement from final reduction gears and functions to rotate the crawler belt 51. As construction vehicles are operated in soil and rock, crawler belt bushings need wear resistance at the inner and outer circumferential surfaces. Vehicles also travel, running over and colliding against soil and rock, crawler belt bushings need tremendously high strength and toughness. To meet these requirements, there have been proposed the following producing methods for crawler belt bushings.

(1) A case hardening steel is carburized to form very hard martensite on its inner and outer circumferential surface layers, thereby ensuring wear resistance and strength (e.g. Japanese Patent Publication (KOKOKU) No. 52-34806 (1977)).

(2) A medium carbon steel is used as a bushing material. The bushing material is thermally refined and its inner and outer circumferential surfaces are respectively induction hardened to form very hard martensite thereon. After hardened by induction hardening from the outer circumferential surface, the bushing material is induction hardened from the inner circumferential surface, so that a V-shaped hardened layer comprising tempered martensite is formed between the inner and outer hardened layers, thereby ensuring wear resistance and strength (Japanese Patent Publication (KOKOKU) No. 63-16314).

(3) A medium carbon steel, whose hardenability is carefully controlled by precise adjustment on its chemical composition, is used for the bushing. Such a steel is heated in a furnace at a temperature of 800° C. or more and then rapidly cooled thereby controlling the hardened depths of the inner and outer circumferential surfaces to ensure wear resistance and strength.

FIGS. 37(*a*), (*b*) and (*c*) schematically show typical hardening patterns for the bushings manufactured by the above conventional methods, and FIG. 37(*d*) shows the distributions of hardness in the cross sections of these bushings. All of the distributions indicate that there is formed a soft layer at the wall core of the bushing.

These methods, however, reveal their own drawbacks. The carburization method (1) consumes considerable carburization time and has the economical problem of using large amounts of carburizing gas. When producing large-sized crawler belt bushings having great thickness for example, a great hardened depth is required in order to ensure strength and wear resistance, which gives rise to a decrease in productivity and to increased cost. Further, since it takes long time to carburize and heat the inner and outer circumferential surfaces, there will be formed a grain boundary oxidized layer and imperfectly hardened layer having a thickness of several tens of $\mu$m, which causes a decrease in fatigue strength and impairs impact resistance properties.

The induction hardening method (2) is improved over the carburization method (1) in terms of cost, but involves thermal refining treatment in order to assure hardness prior to the induction hardening and double quenching of the inner and outer circumferential surfaces, so that this method has proved to remain a costly heating treatment. Further, when induction hardening the inner circumferential surface of a small-diameter tubular part, an inner circumference heating coil is needed and such a heating coil is difficult to manufacture. Therefore, in many cases, the inner circumferential surface of a tubular part is hardened by the above carburization treatment, resulting in high cost.

The outer circumferential surface of a bushing in use is subjected to severe wearing conditions due to soil and rock. To increase the wear life of the bushing, the quench hardened layer at the outer circumferential surface is preferably more deepened. To this end, there has been made an attempt in Japanese Patent Publication (KOKOKU) No. 63-16314 (1988). According to this publication, after the outer circumferential surface of a steel is once hardened deeply by induction hardening from the outer circumferential surface, the inner circumferential surface is shallowly hardened by induction hardening from the inner circumferential surface, and a soft layer is formed between these hardened layers by high temperature tempering. In any case, double induction hardening is involved, which is disadvantageous in terms of productivity and economy. In the method of this publication, it is necessary to control the induction hardening from the outer circumferential so as to restrict the hardness of the inner circumferential surface to $H_{RC}$ 40, thereby preventing quenching crack during the later induction hardening of the inner circumferential surface. For applying this method to a comparatively thin tubular part (e.g., crawler belt bushing), it is necessary to control the temperature of the inner circumferential surface with high precision, during the induction heating from the outer circumferential surface and/or to control the hardenability (DI value) of the steel material to be used. As a result, the technical difficulty in deepening the outer circumferential surface hardened layer and increased material cost are inevitable.

Japanese Patent Publication (KOKOKU) No. 1-37453 discloses a quite economical heating process for producing through hardened crawler bushings. This process uses a medium carbon steel for the bushing. While scan induction heating is carried out from the outer circumferential surface of the bushing, the bushing is cooled from the outer circumferential surface, so that the bushing is hardened across its entire thickness. For through hardening the bushing across its entire thickness by cooling from the outer circumferential surface only, high hardenability is required when this process is applied to the production of thick, large-sized crawler belt bushings, which inevitably entails an increase in cost. In addition, in view of susceptibility to quenching crack during cooling, the steel material that can be used in this process is limited to medium carbon low alloy steels having carbon contents of 0.5 wt % or less. As a result, it becomes difficult to improve the wear resistance of the outer circumferential surface of a crawler belt bushing.

The hardening process (3) has overcome the cost problems presented by the processes (1) and (2), but presents other problems. Specifically, it is necessary for this process to accurately and narrowly control the hardenability (DI value) of the steel material used, by correctly grasping the relationship between the thickness of the steel and the cooling rate. This process has a problem in the availability of materials to be used. In addition, as the thickness of the busing becomes smaller, the bushing is more through hardened across its entire thickness, causing higher tensile residual stress at the inner and outer circumferential surfaces. This could be a cause for quenching crack and a considerable decrease in fatigue strength. To avoid this problem, the DI value should be decreased and as a result, the steel materials which meet this requirement will not be commercially available. Further, if steels having small DI values are used, the resultant bushings will have variations in hardness.

The present invention has been directed to overcoming the above-described problems and therefore the prime object of the invention is to provide a crawler belt bushing and its producing method, improved over the products and processes of the above conventional carburization and induction hardening in terms of productivity and cost. This crawler belt bushing is produced by heating a tubular bushing workpiece made of steel to a quenching temperature and then quenching the workpiece in a series of quenching operation, without causing quenching crack, so that the workpiece is quench hardened across its entire thickness.

The invention also aims to provide a long wear life, tough crawler belt bushing and its producing method, improved over the products and processes of the above conventional carburization and induction hardening in terms of productivity and cost. This bushing is produced by heating a tubular bushing workpiece made of steel to a quenching temperature and then applying a series of quenching operation to this workpiece, the operation comprising: advance cooling of the workpiece from the inner circumferential surface and cooling of the workpiece from the outer circumferential surface after waiting a certain time. With this process, quench hardened layers are formed at the inner and outer circumferential surfaces respectively, such that at least the depth of the outer circumferential surface hardened layer is greater than that of the inner circumferential surface hardened layer.

The invention provides a crawler belt bushing producing method applicable to inexpensive steel materials having higher commercial availability than the above-described through-hardening process from the outer circumferential surface only, by achieving through hardening by cooling from both inner and outer circumferential surfaces although there is a difference between the starting time for the inner circumferential surface cooling and the starting time for the outer circumferential surface cooling.

The invention also aims to provide a crawler belt bushing and its producing method, improved over the products and processes of the above conventional carburization and induction hardening in terms of productivity and cost, this bushing being produced by the following process. A tubular bushing workpiece made of steel is heated by scan induction heating from its outer circumferential surface such that at least the temperature of the inner circumferential surface of the workpiece is raised to a quenching temperature. Then, a series of quenching operation is carried out as follows. While firstly starting cooling from the inner circumferential surface, the outer circumferential surface is heated by induction heating to restrict the cooling of the outer circumferential surface occurring from the inner circumferential surface. After waiting a certain time in order to prevent the core of the workpiece from being fully hardened, cooling from the outer circumferential surface is started. Through these steps, quench hardened layers are formed at the inner and outer circumferential surfaces respectively.

For ensuring formation of a quench hardened layer at the inner circumferential surface, the advance cooling from the inner circumferential surface, the induction heating from the outer circumferential surface and the later cooling from the outer circumferential surface are carried out as described earlier, thereby forming a soft layer within the core of the bushing at a cross-sectional position closer to the inner circumferential surface. With this arrangement, a soft layer can be formed in the core, even when using, as a bushing material, a steel having such a great DI value that the steel is through hardened by cooling from the inner circumferential surface only. In consequence, quenching crack can be prevented and the hardened depth of the outer circumferential surface can be greater than the hardened dept of the inner circumferential surface, so that a crawler belt bushing improved in wear resistance and fatigue strength and its producing method can be provided.

The above induction heating/hardening method of the invention is applicable to tubular parts similar to crawler belt bushings. Since this method does not need to carry out heat hardening from the inner circumferential surface and therefore does not use an induction heating coil for an inner circumferential surface, small-diameter tubular parts (e.g., small-sized crawler belt bushings) and thin tubular parts (e.g., crawler belt bushings) can be produced at low cost.

Further, since a soft layer can be formed within the wall of the crawler belt bushing and quenching crack can be prevented even when using a steel having high hardenability as has been noted above, the invention can provide a crawler belt bushing having high wear resistance at its outer circumferential surface and its producing method, by hardening a steel material which has comparatively high hardenability and a carbon content of about 2.0 wt % and is composed of austenite containing cementite grains dispersed therein. It is preferable to substantially uniformly disperse cementite in the workpiece by thermal refining or the like, prior to starting of the hardening operation.

DISCLOSURE OF THE INVENTION

According to a first aspect of the invention, there is provided a crawler belt bushing producing method, wherein a workpiece of a crawler belt bushing made of a medium or high carbon steel or a medium or high carbon low alloy steel is heated to a quenching temperature or more; by use of a hardening system which can independently start outer circumferential surface cooling and inner circumferential surface cooling, the workpiece is first cooled from either one of its outer circumferential surface and inner circumferential surface and then cooling is carried out from the other circumferential surface so that the workpiece is hardened through its entire thickness; and then the workpiece is tempered.

In the above method, after the bushing workpiece is heated to a quenching temperature, a series of quenching operation is carried out using a hardening system which can independently start outer circumferential surface cooling and inner circumferential surface cooling and using a cooling medium such as water, water-soluble quenching liquid or oil. The quenching operation comprises the steps of (i) advance cooling from either one of the inner and outer circumferential surfaces to reduce heat capacity at the core of the workpiece to provide a heat gradient and (ii) cooling from the other circumferential surface which is started after waiting for a certain time to reduce tensile stress due to possible heat and deformation stresses generated during quenching and therefore to reduce susceptibility to quenching crack caused by through hardening. With this method, possible quenching crack due to through hardening can be prevented even when using a steel which has a high carbon content and high susceptibility to quenching crack and is usually through hardened by simultaneous cooling from the inner and outer circumferential surfaces. Accordingly, a bushing having improved wear life at the outer circumferential surface can be economically produced with this method.

By using a medium or high carbon steel having a carbon content of 0.35 wt % to 1.5 wt % as a steel material for the bushing and increasing the hardness of the quench hardened layer at the outer circumferential surface to be equal or more than those of carburization hardened bushings, the crawler belt bushing improved in wear resistance and wear life can be produced at low cost. The alloy composition of a steel is a factor that determines the hardenability of the steel. The alloy compositions of the steels used in the invention are determined by the lower limit of DI value with which the bushing is through hardened by simultaneous cooling from the inner and outer circumferential surfaces. As has been noted above, the invention is basically directed to cooling from the inner and outer circumferential surfaces and therefore it can use steel materials less expensive than medium carbon low alloy steels which can be through hardened by cooling from the outer circumferential surface only. This advantage leads to considerable cost reduction and makes the invention applicable to the production of large-sized, thick crawler belt bushings.

While the wear resistance of the outer circumferential surface of the bushing is ensured by use of medium and high carbon steels, the impact resistance (toughness) of the bushing is obtained by allowing self-tempering of the inner circumference by finishing the cooling from the inner circumferential surface at an early time. The impact resistance of the bushing may be obtained by induction tempering the workpiece from the inner circumferential surface subsequently to the quenching operation so that the hardened depth of the inner circumferential surface is adjusted to 450 to 600 Hv. Accordingly, the crawler belt bushing having wear resistance and impact resistance as high as those of carburization hardened layers while keeping high hardness at the quench hardened layer of the outer circumferential surface can be produced at low cost by the invention.

The invention is based on the thermal operation in which after substantially uniform, entire heating of the bushing, cooling from either one of the inner or outer circumferential surfaces is first started and then cooling from the other circumferential surface is stared, so that hardening can be completed within one cycle of operation. Unlike the conventional induction quenching, the invention does not need to do adjustment twice, that is, hardened depth adjustment for the inner circumferential surface and for the outer circumferential surface, and does not need to heat/quench the workpiece from the inner and outer circumferential surfaces separately, so that the invention provides high productivity. The heating method is not limited to induction heating and furnace heating, but induction heating is preferred when taking into account productivity, system cost and energy efficiency.

Further, the hardening process of the invention employs a quenching system in which starting time for inner circumferential surface cooling and starting time for outer circumferential surface cooling can be independently determined. Uneven cooling is likely to occur when cooling the inner circumferential surface of a tubular body, and therefore the invention preferably employs jet cooling such as water spraying or oil spraying. In order to prevent the cooling medium for the inner circumferential surface from touching the outer circumference during the advance cooling from the inner circumferential surface, it is preferable to set the spray at an appropriate angle in consideration of the flows of the cooling media as shown in FIG. 1 or to provide a partition (shielding plate) as indicated by A in FIG. 1.

In the case incorporating furnace heating, when a multiplicity of bushings is cooled by employing the above-described advance cooling from the inner or outer circumferential surface, it is preferable that the bushings be aligned with their adjacent end faces in contact with each other, like one steel pipe as shown in FIGS. 2(*a*) and 2(*b*), and then their inner circumferential surfaces and outer circumferential surfaces be respectively cooled by independently controlling inner circumferential surface cooling water 2 and outer circumferential surface cooling water 3. It should be noted that the cooling water 2 and the cooling water 3 are shielded from each other with a shielding plate 4. In the case shown in FIGS. 2(*b*) and 2(*c*), there is disposed an inner circumferential surface cooling nozzle 5.

The time difference hardening method, in which while heating a part of the bushing by scan heating with an induction coil, cooling from, for instance, the inner circumferential surface starts in advance of cooling from the outer circumferential surface, does not involve a large hardening system and has a high degree of freedom in production. A preferred arrangement to effect this method is shown in FIG. 3 in which shielding plates 4, 4' are positioned at the upper and lower end faces of the bushing 1 respectively and the inner circumference surface cooling nozzle 5 and the outer circumferential surface cooling nozzle 6 are designed such that the nozzle 5 firstly cools an induction heated zone and a specified timer later, the nozzle 6 starts cooling. Preferably, the scan hardening is carried out by the relative movement of an induction heating coil 7, the nozzle 5 and the nozzle 6 along the axis of the bushing 1 and such a relative movement is preferably carried out while the bushing 1 being rotated. It is a matter of course that when cooling the outer circumferential surface first, the cooling nozzles should be arranged oppositely to the above arrangement.

As has been described above, the invention is designed such that (1) a bushing is substantially uniformly heated by induction heating or furnace heating and (2) cooling from the inner or outer circumferential surface of the bushing is started in advance of (3) cooling from the outer or inner circumferential surface to eliminate susceptibility to quenching crack, by use of a cooling medium such as oil or water. With this arrangement, the crawler belt bushing made of inexpensive, low hardenability, medium or high carbon steel can be quench-hardened throughout its entire thickness within one cycle of operation and the bushing thus hardened is improved in the wear life of the outer circumferential surface and production cost.

The formation of the deeply hardened layer having high hardness, high wear resistance and carbon content equal to or higher than those of carburized bushings leads to considerable improvements in the wear resistance and wear life of the resultant bushing. Further, the formation of the soft layer in the core ensures toughness as high as that of the conventional bushings, whereas tempering of the inner circumferential surface at higher temperatures increases the toughness of the inner circumferential surface layer. These all lead to improvements in the impact strength and functions of the bushing.

According to a second aspect of the invention, there is provided a crawler belt bushing producing method wherein, after a workpiece of a crawler belt bushing made of steel is heated to a quenching temperature, (a) the cooling rate of the outer circumferential surface of the workpiece is increased by first cooling of the workpiece from its inner circumferential surface in order to reduce heat capacity at the core of the workpiece and by second cooling of the workpiece from its outer circumferential surface which is started a certain time after the first cooling and/or (b) the cooling rate of the outer circumferential surface of the workpiece is increased by first cooling of the workpiece from its inner circumferential surface in order to partially make the core of the workpiece unhardenable by utilizing the mass effect of the wall of the workpiece and by second cooling of the workpiece from its outer circumferential surface which is started a certain time after the first cooling, whereby a soft layer is formed within the core of the workpiece at a cross-sectional position closer to the inner circumferential surface and the hardened depth of the outer circumferential surface is made to be greater than the hardened depth of the inner circumferential surface, these processes (a) and (b) being carried out within one cycle of quenching operation, using a hardening system capable of performing inner circumferential surface cooling and outer circumferential surface cooling.

In the invention having the above feature, a soft layer is formed within the wall core at a cross-sectional position closer to the inner circumferential surface, so that the bushing has a U-shaped hardness distribution. With this arrangement, when using, as the material of the bushing, a steel which is usually through hardened by simultaneous cooling from the inner and outer circumferential surfaces, the bushing can be prevented from quenching crack. Further, the hardened depth of the outer circumferential surface is made to be greater than the hardened depth of the inner circumferential surface, which entails an improvement in the wear life of the outer circumferential surface of the bushing and enables economical manufacture.

The hardenabilities of the steels to which the invention is applicable are dependent on their alloy compositions. Steels having a wider variety of alloy compositions can be used by employing a wider range of DI values with which the hardened depth achieved by cooling from the inner circumferential surface only is about one half the thickness of the bushing or less, even though the bushing is through hardened by simultaneous cooling from the inner and outer circumferential surfaces. With this arrangement, commercially available, inexpensive steel materials can be used in the invention and a hardened depth one-half the thickness of the bushing or more can be easily ensured for the outer circumferential surface thereby highly improving the wear life of the outer circumference of the bushing.

The wear resistance of the outer circumferential surface of the bushing is improved by the arrangement in which after heating the workpiece to a quenching temperature, quenching is carried out by advance cooling from the inner circumferential surface and later cooling from the outer circumferential surface and in which induction tempering is carried out from the inner circumferential surface while the hardened depth of the outer circumferential surface being kept high, thereby increasing particularly the toughness of the inner circumference surface hardened layer. This enables the economical manufacture of the bushing having wear resistance and impact resistance equal to or higher than those of carburization hardened layers.

According to the invention, in one cycle of operation, (1) a workpiece is substantially uniformly heated by induction heating or furnace heating and then, (2) cooling from the inner circumferential surface of the workpiece is started in advance of (3) cooling from the outer circumferential surface, by use of a cooling medium such as oil or water, whereby the hardened depth of the inner circumferential surface is made to be smaller than that of the outer circumferential surface and whereby the cooling of the outer circumferential surface can be expedited by the advance cooling from the inner circumferential surface to further deepen the hardened layer. With this arrangement, a soft layer can be formed at the core thereby preventing possible quenching crack, even when using a steel that is usually through hardened by simultaneous cooling from the inner and outer circumferential surfaces. Further, the outer circumferential surface hardened layer can be made to be deeper than the inner circumferential surface hardened layer, to improve the wear life of the bushing. This, in consequence, brings about lots of benefits in economy.

In addition, the formation of the deeply hardened layer on the outer circumferential surface entails improvements in the wear resistance and wear life of the bushing, the hardened layer having high wear resistance, high hardness and carbon content substantially equal to those of carburized bushings. Further, the formation of the soft layer in the core assures toughness equal to that of the conventional bushings, and the high temperature tempering of the inner circumferential surface toughens the inner circumferential surface layer. These all contribute to improvements in the impact strength and functions of the bushing.

According to a third aspect of the invention, there is provided a crawler belt bushing producing method wherein, after a workpiece of a crawler belt bushing made of steel is induction heated from its outer circumferential surface such that at least the temperature of the inner circumferential surface of the workpiece is raised to a quenching temperature, a series of quenching operation comprising:

(a) firstly cooling the workpiece from the inner circumferential surface;

(b) cooling the workpiece from the inner circumferential surface while heating the workpiece from the outer circumferential surface; and (c) cooling the workpiece from the outer circumferential surface, is performed so as to form quench hardened layers which extend toward the wall core of the workpiece from the outer circumferential surface and from the inner circumferential surface respectively and form a soft, imperfectly hardened layer between these quench hardened layers.

According to a forth aspect of the invention, there is provided a crawler belt bushing producing method wherein, while a workpiece of a crawler belt bushing made of steel being heated from its outer circumferential surface by scan induction heating, using at least two vertically aligned, induction coils, (a) the temperature of the inner circumferential surface of the workpiece is raised to a quenching temperature equal to the transformation temperature of A1, A3 or Acm or more;

(b) the workpiece is partially heated from the outer circumferential surface by the induction coils while carrying out first cooling from the inner circumferential surface; and (c) the workpiece is then cooled from the outer circumferential surface;

whereby the inner and outer circumferential surfaces are quench hardened so as to be substantially martensitic, these processes (a), (b) and (c) being carried out at a certain position of the workpiece.

In the invention having the above feature, after the workpiece is heated from the outer circumferential surface by induction heating so that the temperature of the inner circumferential surface is raised to a quenching temperature, a series of quenching operation is carried out in the following way, using a cooling medium such as water, water-soluble quenching liquid or quenching oil. In the quenching operation, cooling from the inner circumferential surface is carried out while partially heating the workpiece from the outer circumferential surface by induction heating, thereby restricting the cooling of the outer circumference from the inside. Then, cooling from the outer circumferential surface is carried out after waiting a certain time which is long enough to disallow the inside of the wall to be fully quenched by the cooling from the outer circumferential surface. With this arrangement, a soft, imperfectly hardened structure can be formed within the core and a satisfactorily hardened depth can be obtained at the outer circumferential surface by the later cooling from the outer circumferential surface that starts after waiting a certain time. This, in consequence, enables the economical producing method for the crawler belt bushing having quench hardened layers at the inner and outer circumferential surfaces.

When using a steel which is usually through hardened by the simultaneous cooling from the inner and outer circumferential surfaces or by cooling from the inner circumferential surface only, the invention can form a soft layer within the core at a cross-sectional position closer to the inner circumferential surface, because of the induction heating from the outer circumference that is carried out during the advance cooling from the inner circumferential surface. Therefore, in many cases, there is substantially no need to control the hardenability of the steel to be used in the invention, which enables use of inexpensive, commercially available steel materials. This leads to cost reduction.

It should be noted that the advance cooling from the inner circumferential surface in the invention is intended for reducing heat capacity in the core of the bushing. The reduction in heat capacity, in turn, expedites the later cooling from the outer circumferential surface so that the outer circumferential surface hardened layer can be more deepened than the inner circumferential surface hardened layer. The producing method incorporating the above principle is particularly suited for the production of crawler belt bushings having excellent wear life at their outer circumferential surfaces.

For further deepening the quench hardened layer of the outer circumferential surface, a steel, which has at least such hardenability (DI value) that the hardened depth obtained by hardening from the outer circumferential surface only is one half the thickness of the bushing, is used for the bushing; the bushing is hardened to a depth equal to the wear critical point (about one half the thickness of the bushing); and the above-described soft hardened layer is formed in the wall core at a position closer to the inner circumferential surface. The resultant bushing is superior in strength, toughness, and wear life.

As the method of induction heating the bushing from the outer circumferential surface, an entire heating method or a scan heating method may be employed. As shown in FIG. 4, in the entire heating method, when heating the outer circumferential surface with high frequency coil 2 during cooling from the inner circumferential surface with an inner circumferential surface cooling nozzle 4, the hardened depths of the inner and outer circumferential surfaces can be controlled as required by controlling the electric power of the high frequency coil 2. The cooling from the outer circumferential surface may be carried out, for example, by moving outer circumferential surface cooling nozzle 5 from underneath after moving the high frequency coil 2 upward. Another arrangement is such that the bushing is cooled by a coolant jetted through the clearances between the inductors of the high frequency coil 2.

As shown in FIG. 5, in the scan heating method, a wide induction coil or, more preferably, two or more vertically aligned induction coils (high frequency coils) 8, 9 are used. These induction heating coils are arranged to perform induction heating so as to prevent the outer circumferential surface from being cooled by the cooling from the inner circumferential surface. In this way, the core of the wall will not be fully hardened.

The hardened depths of the inner and outer circumferential surfaces can be easily controlled in the following way. Taking into account the relative moving speed of the induction coils and the bushing, the induction heating of the outer circumferential surface during the cooling from the inner circumferential surface is mainly performed by the second high frequency coil 9 and the distance between the cooling position of the outer circumference of the bushing cooled by the outer circumferential surface cooling nozzle 11 and the position of the second high frequency coil 9 is adjusted to control the time to be taken for induction heating, that is, the time after the cooling from the inner circumferential surface is started until the cooling from the outer circumferential surface is started.

These induction heating/hardening methods do not need to heat and quench the bushing from the inner circumferential surface and therefore enables the economical production of small-diameter tubular parts (e.g., small-sized crawler belt bushings) and extremely thin tubular parts (crawler belt bushings), for which induction heating coils for an inner circumferential surface are difficult to produce.

In view of wear resistance and strength, the carbon contents of the steels used in this example are preferably 0.35 to 2.0 wt %, so that the hardened bushing has a hardness of $H_{RC}$ 50 or more and is improved in the hardness of the outer circumferential surface hardened layer.

It is generally known that increasing of the carbon content of a steel to be used is effective in economically manufacturing crawler belt bushings having superior wear resistance and wear life. The conventional induction hardening methods are not applied to steels having carbon contents of 0.55 wt % or more because there is a high risk of quenching crack. Thanks to the foregoing heating/cooling principle, the invention can prevent quenching crack and, therefore, can economically produce a crawler belt bushing having superior wear resistance at the outer circumferential surface by hardening the bushing in an austenite state in which cementite grains are dispersed, even when steel materials having comparatively good hardenability and carbon contents as high as 2.0 wt % are used. Note that it is preferable to treat the bushing, for example, by thermal refining, prior to the hardening operation, in order that cementite grains are substantially evenly dispersed in the structure of the bushing.

For particularly improving the wear resistance of the outer circumferential surface, after the bushing workpiece is heated to a quenching temperature, quenching is carried out by the above method wherein the inner circumferential surface is first cooled, and while the hardened depth of the outer circumferential surface being kept high, the inner circumferential surface is induction tempered, thereby particularly increasing the toughness of the inner circumferential surface hardened layer. This makes it possible to economically produce a crawler belt bushing having wear resistance and impact resistance equal to or higher than those of carburization hardened layers.

One of the features of the invention resides in the thermal operation in which while the scan induction heating being carried out, cooling from the inner circumferential surface is first started and then, the outer circumferential surface is cooled, so that heating/quenching is completed within one cycle of operation. Therefore, there is no need to separately perform hardened depth adjustment and separately perform heating/quenching for the inner and outer circumferential surfaces, which results in high productivity, savings in equipment investment cost, and improved energy efficiency.

In the above hardening method, the hardened depth of the inner circumferential surface can be made to be greater than the hardened depth of the outer circumferential surface, by controlling the output of the outer circumferential surface heating nozzle during the advance cooling from the inner circumferential surface and then carrying out the outer circumferential surface cooling. Therefore, this method is suitably applied to the production of high strength steel pipes used for delivering slurry etc., which require high wear resistance at their inner circumferences.

In view of possible uneven cooling, the suitable cooling method for the inner circumferential surface is jet cooling such as water spraying or oil spraying. It is preferable to set the spray at an angle in consideration of the flows of the cooling media as shown in FIGS. 4 and 5 or to provide a partition such as the shielding plate 1 shown in FIG. 4, in order that the cooling medium for cooling the inner circumferential surface does not interfere with the outer circumference during the advance cooling from the inner circumferential surface.

A multiplicity of bushings can be treated by applying the above hardening method to the bushings aligned with their adjacent end faces in contact with each other as described earlier.

The time difference hardening method, in which the bushing is partially heated by scan heating with the induction coil; the inner circumferential surface is first cooled while heating is carried out with the high frequency coils so as to prevent the outer circumferential surface from being cooled by the cooling from the inner circumferential surface; and then, cooling from the outer circumferential surface is started, does not involve a large hardening system and has a high degree of freedom in the production. In this case, there may be provided the shielding plate 1 and shielding cap 6 near the lower and upper end faces of the bushing respectively, as shown in FIG. 4. Preferably, the inner circumferential surface cooling nozzle 4 first heats the induction heating zone and a certain time later, cooling from the outer circumferential surface is started, and while the bushing 3 being rotated, the induction heating coil 2, the inner and outer circumferential surface cooling nozzles 4, 5 are relatively moved along the axis of the bushing, thereby performing the scan hardening.

According to the invention, the scan induction heating, cooling from the inner circumferential surface and cooling from the outer circumferential surface are subsequently started with time differences, whereby the bushing having quenched hardened layers at the inner and outer circumferential surfaces and the soft layer at the core, or the bushing having the outer circumferential surface hardened layer that is deeper than the inner circumferential surface hardened layer can be manufactured by one cycle of operation. With this arrangement, quenching crack can be prevented even when using a steel which is usually through hardened by the simultaneous cooling from the inner and outer circumferential surfaces. Further, the carbon contents of the steels to be used in the invention can be increased. This leads to improvement in wear life and enables an economical production method for long-life bushings.

In the invention, it is preferable to simultaneously perform cooling from the inner circumferential surface and from the outer circumferential surface at least within a specified zone close to the upper end face and the lower end face, respectively, of the bushing. By controlling the striking position of the cooling medium for the inner circumferential surface and the striking position of the cooling medium for the outer circumferential surface to be equal to each other at least within a specified zone of the bushing during the advance cooling from the inner circumferential surface, a hardened layer can be easily formed on the end face, so that the resulting bushing has an ideal profile in which the imperfectly hardened layer is enclosed by the hardened layers of the inner and outer circumferential surfaces and the hardened layer of the end face.

BRIEF EXPLANATION OF THE DRAWINGS

FIG. 22 shows a method for testing collapse fatigue.

FIG. 23 is a graph showing the results of collapse fatigue tests.

FIG. 35(*b*) is the pattern obtained by the time difference hardening incorporating induction heating, with a constant positional relationship between the cooling nozzles; and FIG. 35(*c*) is the pattern obtained by the hardening process of Example 4.

BEST MODE FOR CARRYING OUT THE INVENTION

Figure 1:
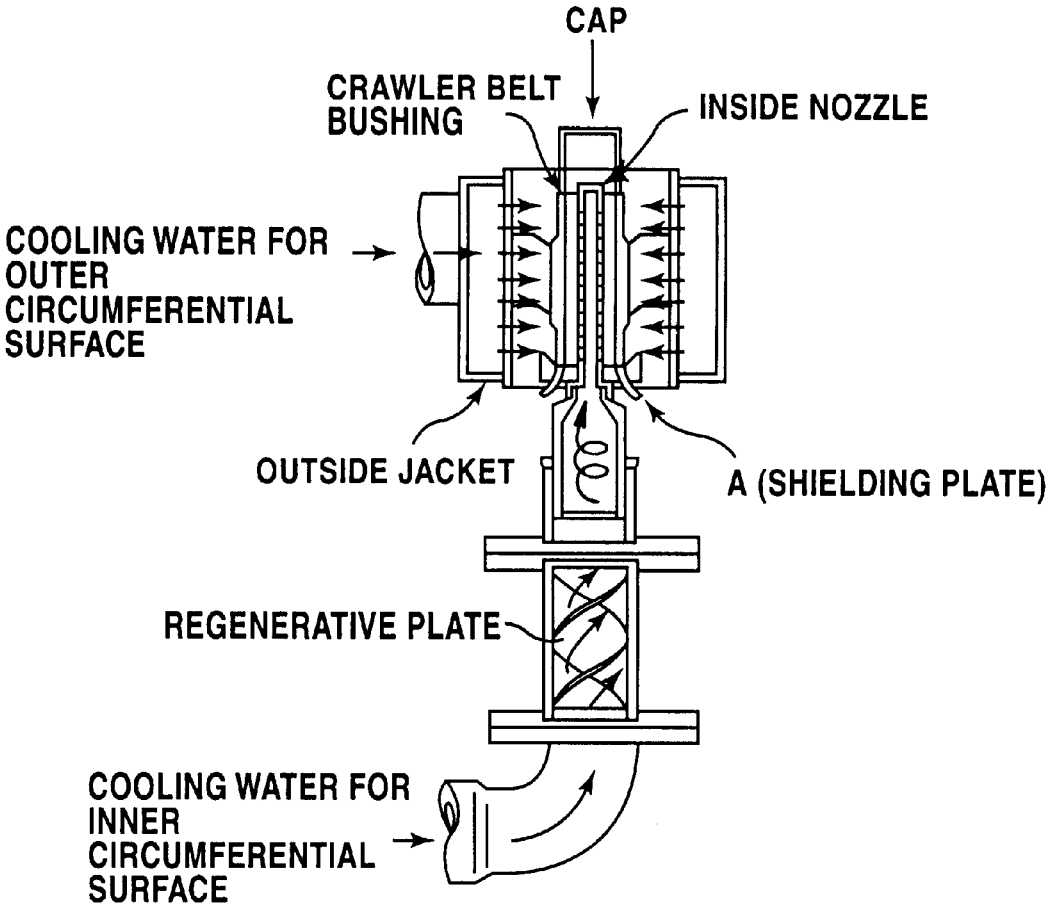
FIG. 1 is a sectional view of a quenching system.
Figure 2A:
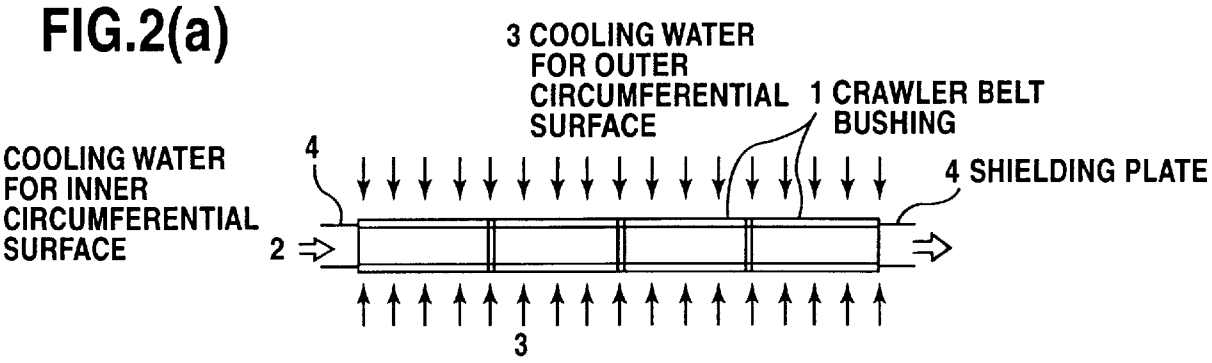
FIGS. 2(*a*) and 2(*b*) are sectional views each showing a quenching system for treating a multiplicity of bushings and FIG. 2(*c*) is a longitudinal section of the system shown in FIG. 2(*b*).
Figure 2C:
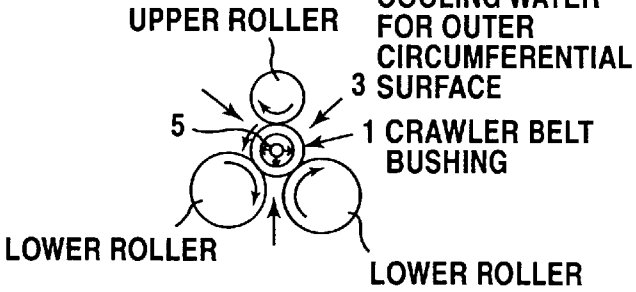
Figure 2B:
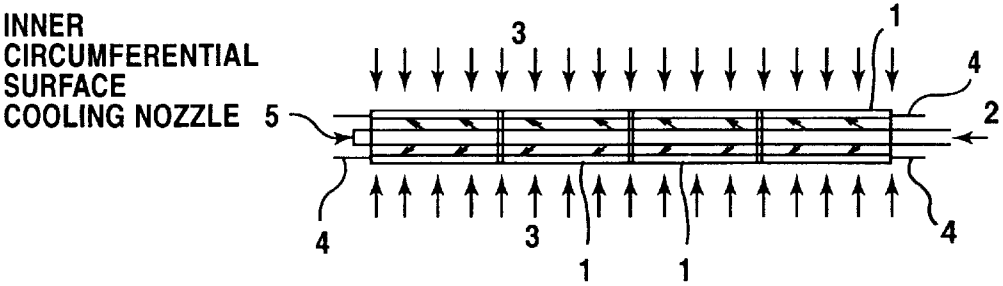

Referring now to the drawings, crawler belt bushings and their producing methods will be explained according to preferred embodiments of the invention.

EXAMPLE 1

Figure 6:
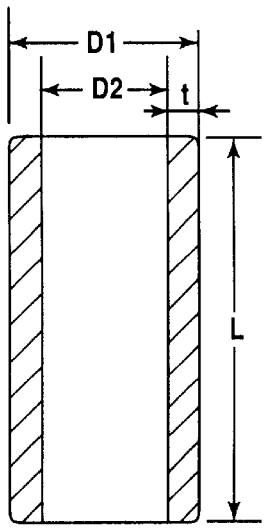
FIG. 6 is a sectional view showing the configuration of a bushing sample.

TABLE 1 shows the steel compositions of the bushings used in Example 1. FIG. 6 shows the configuration of the bushings used in this example and TABLE 2 shows the dimension of each bushing. Heating for hardening was carried out in a furnace in a neutral atmosphere and the spray quenching system shown in FIG. 1 was used. The spray quenching system comprises a spray for cooling the inner circumferential surface of a bushing and another spray for cooling the outer circumferential surface. These sprays are independently controlled so as to start cooling operation at different times. The spray for the inner circumferential surface is designed to have an adequate jetting angle with respect to a normal line of the inner circumferential surface, so as to allow water present in the inner circumference to flow toward the lower part of the bushing without being trapped. Disposed near the lower end of the bushing is a shield plate for dividing a flow of cooling water used for inner circumferential surface cooling from a flow of cooling used for outer circumferential surface cooling. Disposed near the upper end is a cap for dividing a flow of cooling water used for inner circumferential surface cooling from a flow of cooling water used for outer circumferential surface cooling.

TABLE 1

| | STEEL COMPOSITION (WT %) | | | | | | | |
|---|---|---|---|---|---|---|---|---|
| | C | Si | Mn | Cr | P | S | Al | Dl |
| No 1 | 0.58 | 0.18 | 0.72 | — | 0.015 | 0.015 | 0.03 | 0.91 |
| No 2 | 0.54 | 0.23 | 0.81 | — | 0.016 | 0.016 | 0.042 | 0.98 |
| No 3 | 0.62 | 0.28 | 0.98 | — | 0.017 | 0.018 | 0.041 | 1.25 |
| No 4 | 0.61 | 0.19 | 1.17 | — | 0.018 | 0.018 | 0.037 | 1.35 |
| No 5 | 0.64 | 0.24 | 1.32 | — | 0.019 | 0.018 | 0.037 | 1.63 |
| No 6 | 1.34 | 0.18 | 0.68 | 0.21 | 0.017 | 0.015 | 0.032 | |
| No 7 | 0.47 | 0.09 | 0.34 | — | — | — | — | 0.49 |
| No 8 | 0.53 | 0.23 | 0.48 | — | 0.008 | 0.008 | — | 0.69 |
| No 9 | 0.57 | 0.23 | 0.81 | — | 0.021 | 0.017 | 0.038 | 1.01 |
| No 10 | 0.72 | 0.21 | 0.47 | — | 0.025 | 0.02 | 0.014 | 0.81 |

TABLE 2

| | D1 | D2 | t | L |
|---|---|---|---|---|
| A | 41 | 24.4 | 8.3 | 81 |
| B | 47 | 28.2 | 9.4 | 94 |
| C | 59 | 38 | 10.5 | 138 |
| D | 79 | 50 | 14.5 | 202 |

Hardening operation was basically carried out under the above conditions. Specifically, after intensely heating at 850° C. for 30 minutes in a furnace, each crawler belt bushing was quickly loaded in the quenching system shown in FIG. 1. Quenching was carried out by inner circumferential surface cooling and outer circumferential surface cooling under their respective specified conditions and then, followed by low temperature tempering at 140° C. for 3 hours. It should be noted that "entire induction heating"

from the outer circumferential surface of the bushing was incorporated as a part of the heating process.

Figure 7:
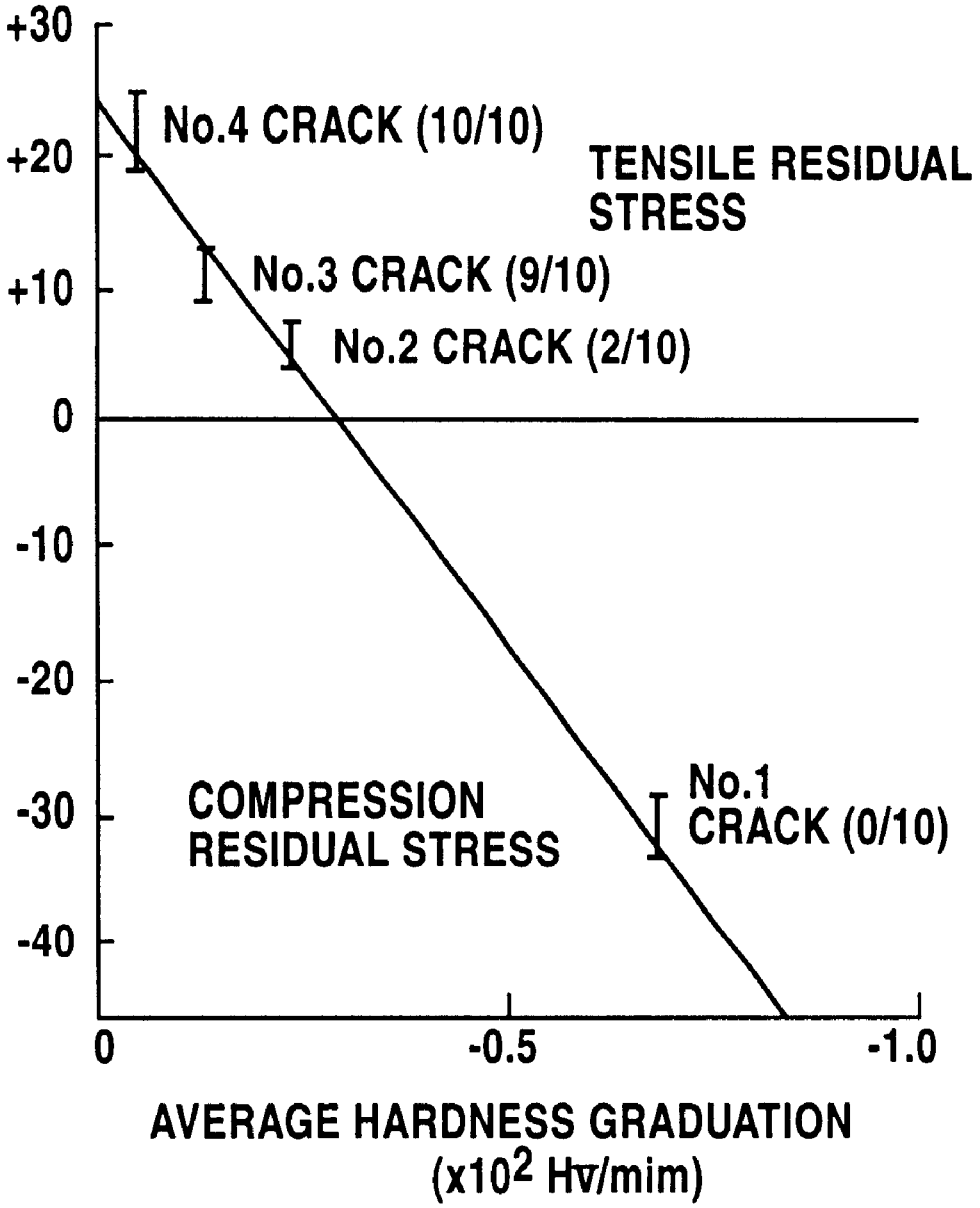
FIG. 7 is a graph showing the relationship between the degree of through hardening of bushings having the dimension D and the frequency of quenching crack in bushings.
Figure 8:
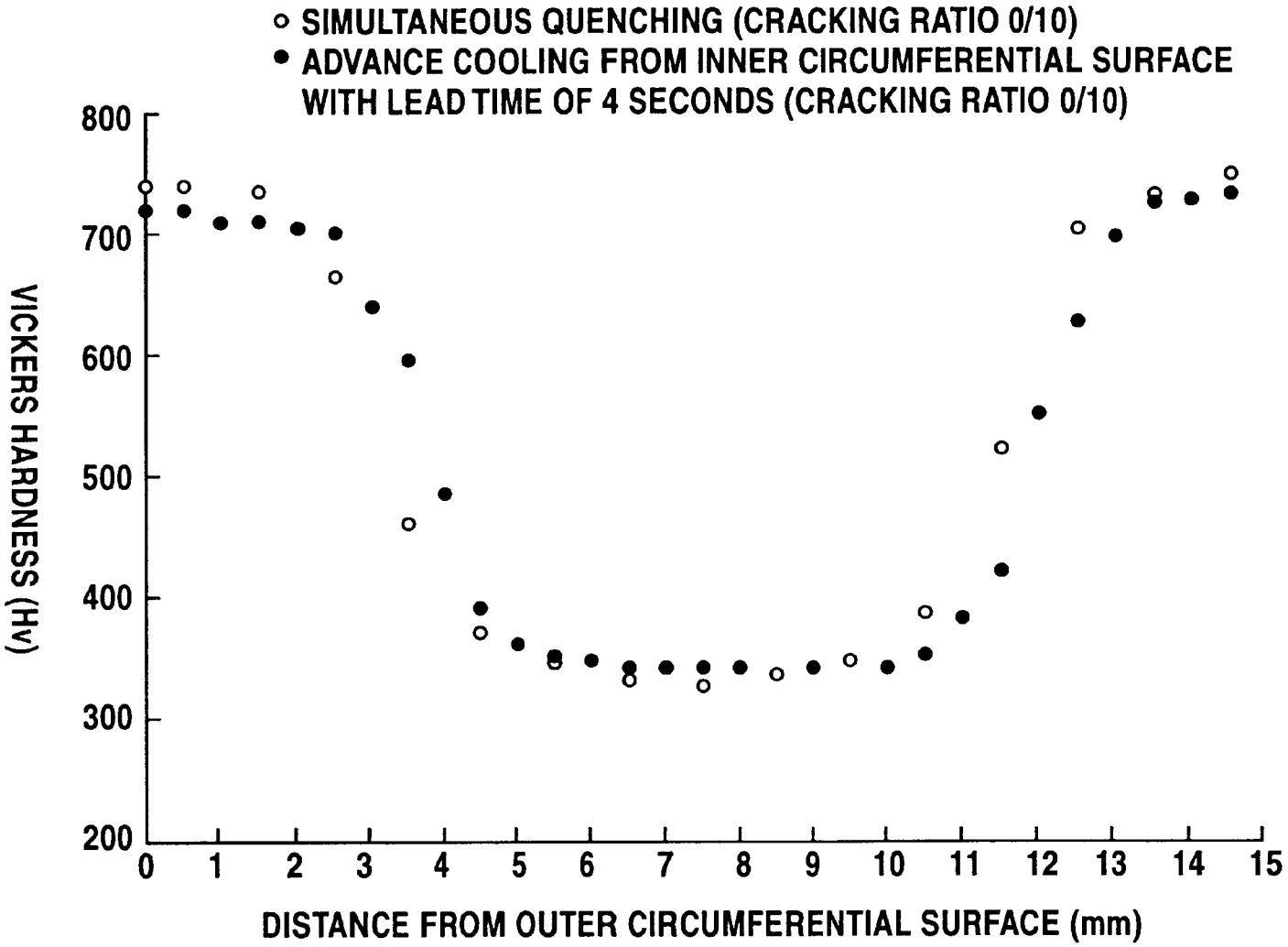
FIG. 8 is a graph showing the distributions of hardness in bushings having the dimension D and the composition No. 1 and treated by the time difference hardening.
Figure 9:
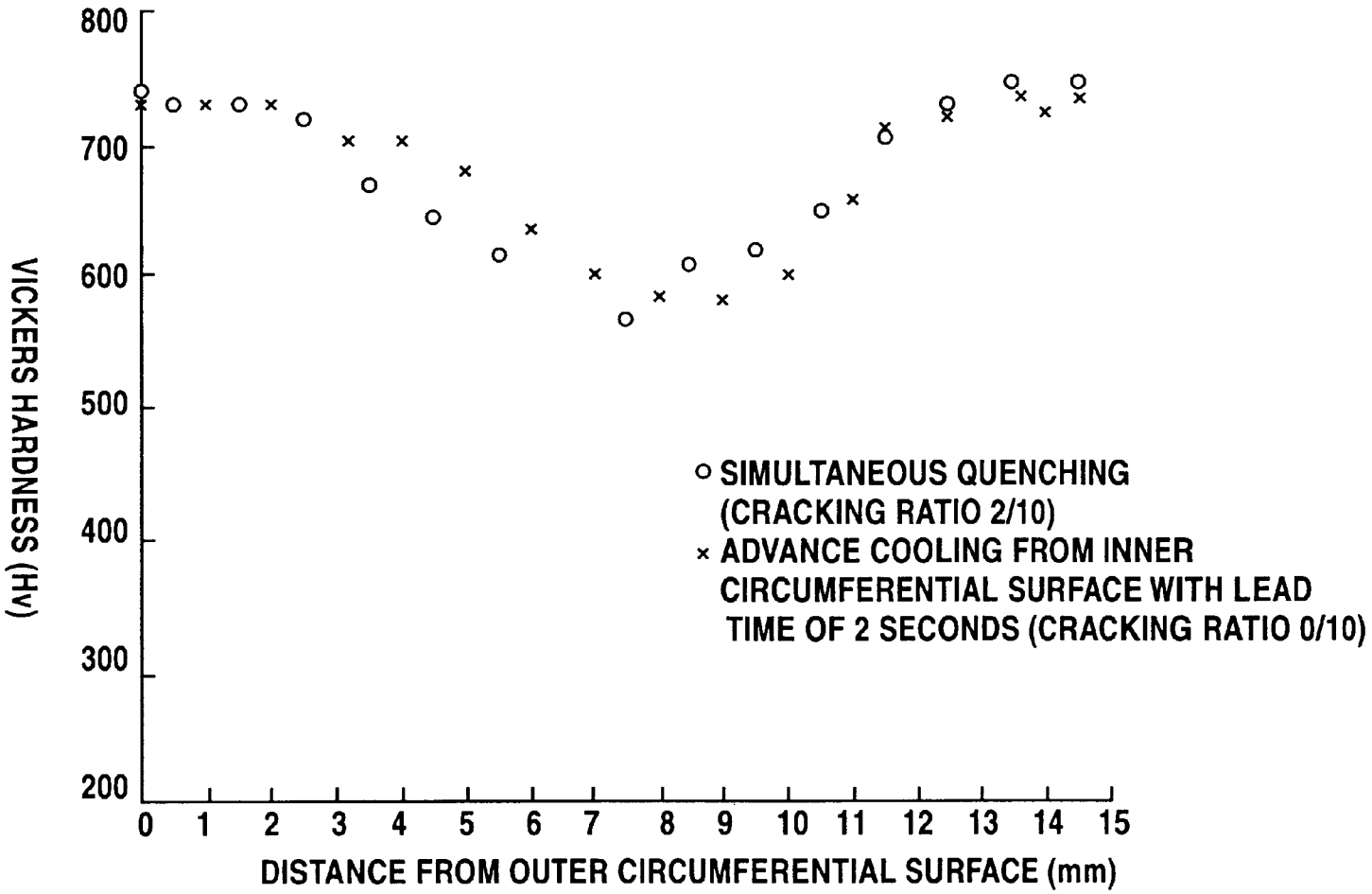
FIG. 9 is a graph showing the distributions of hardness in bushings having the dimension D and the composition No. 2 and treated by the time difference hardening.
Figure 10:
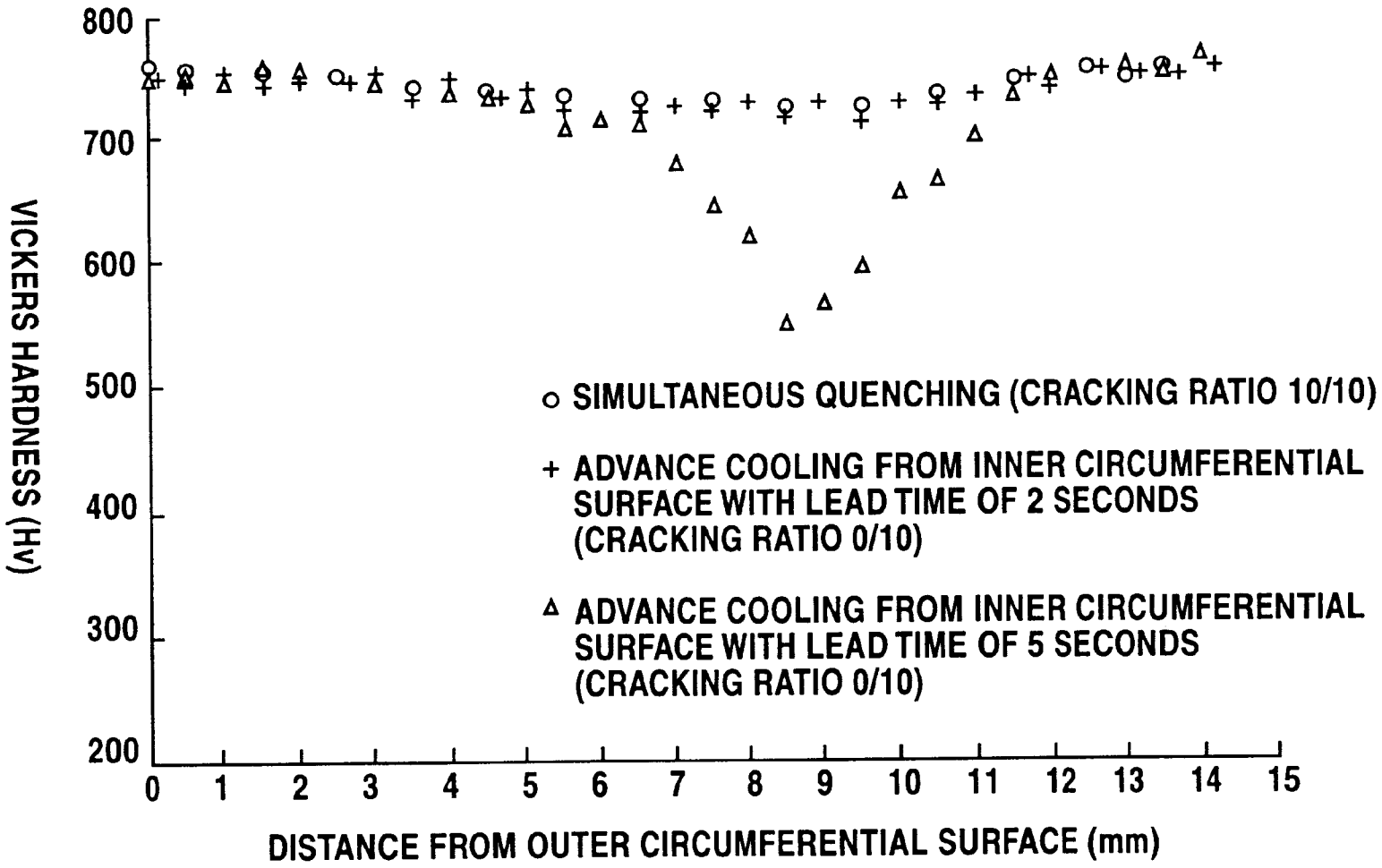
FIG. 10 is a graph showing the distributions of hardness in bushings having the dimension D and the composition No. 4 and treated by the time difference hardening.
Figure 11:
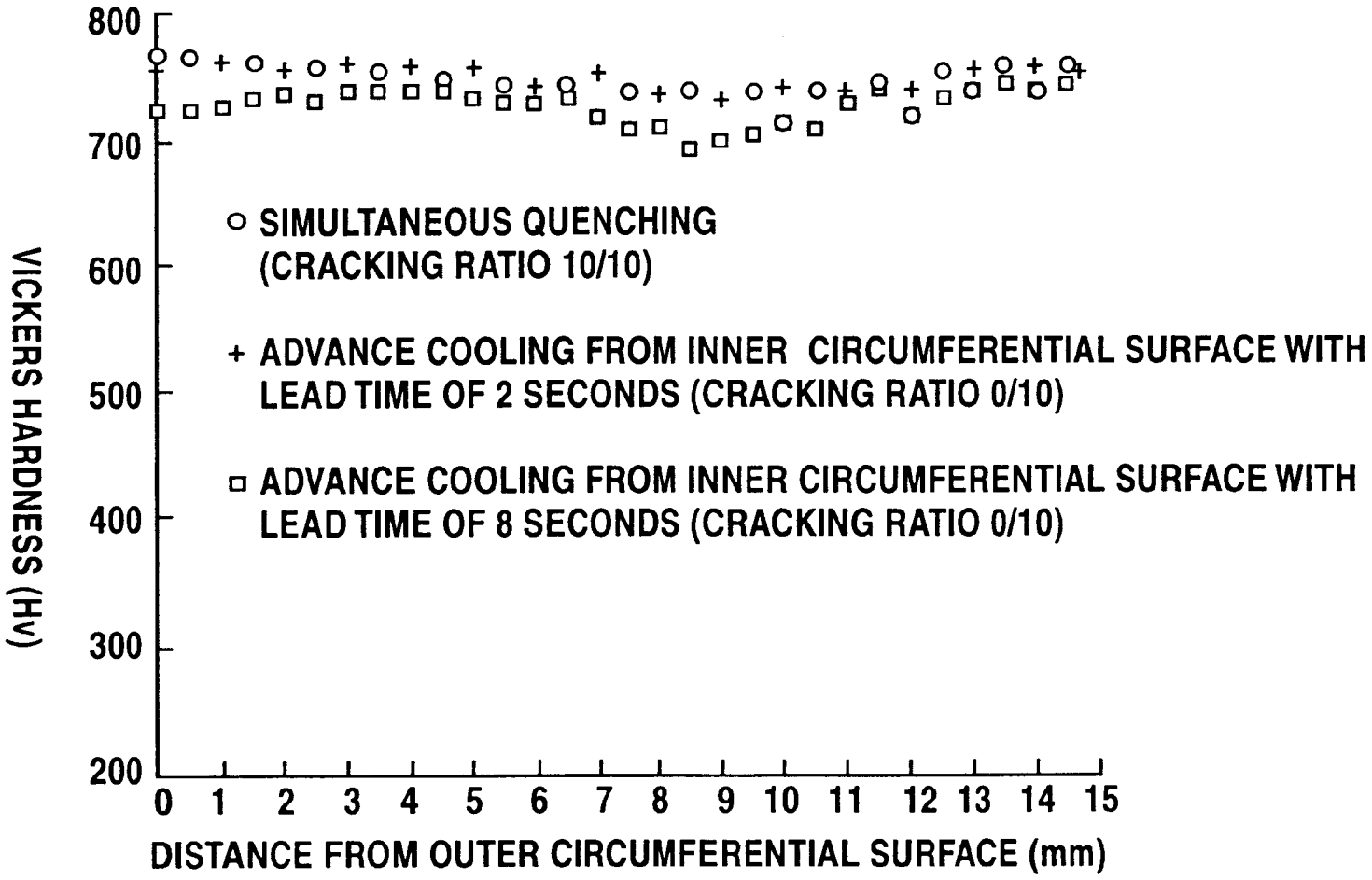
FIG. 11 is a graph showing the distributions of hardness in bushings having the dimension D and the composition No. 5 and treated by the time difference hardening.
Figure 12:
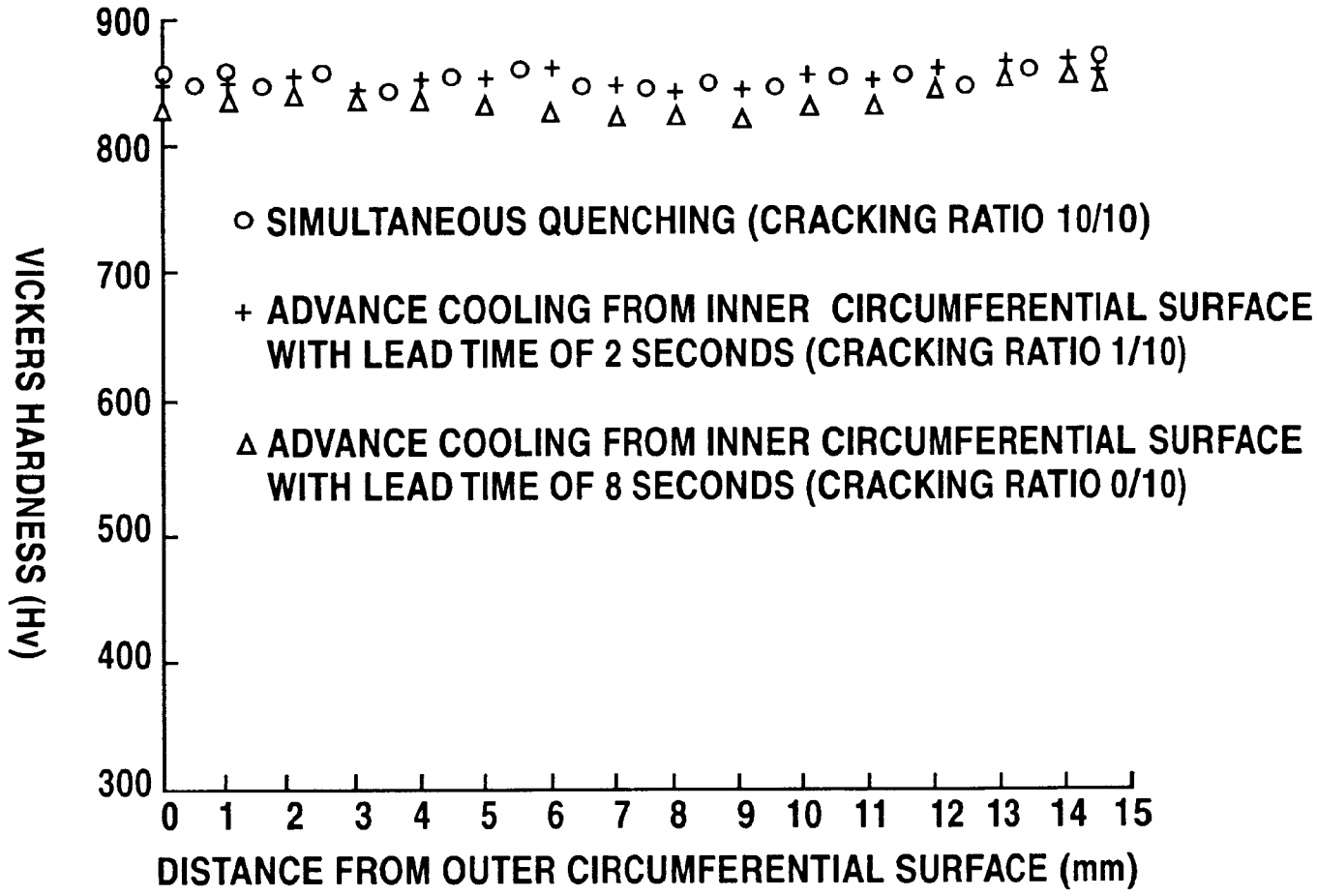
FIG. 12 is a graph showing the distributions of hardness in bushings having the dimension D and the composition No. 6 and treated by the time difference hardening.
Figure 13:
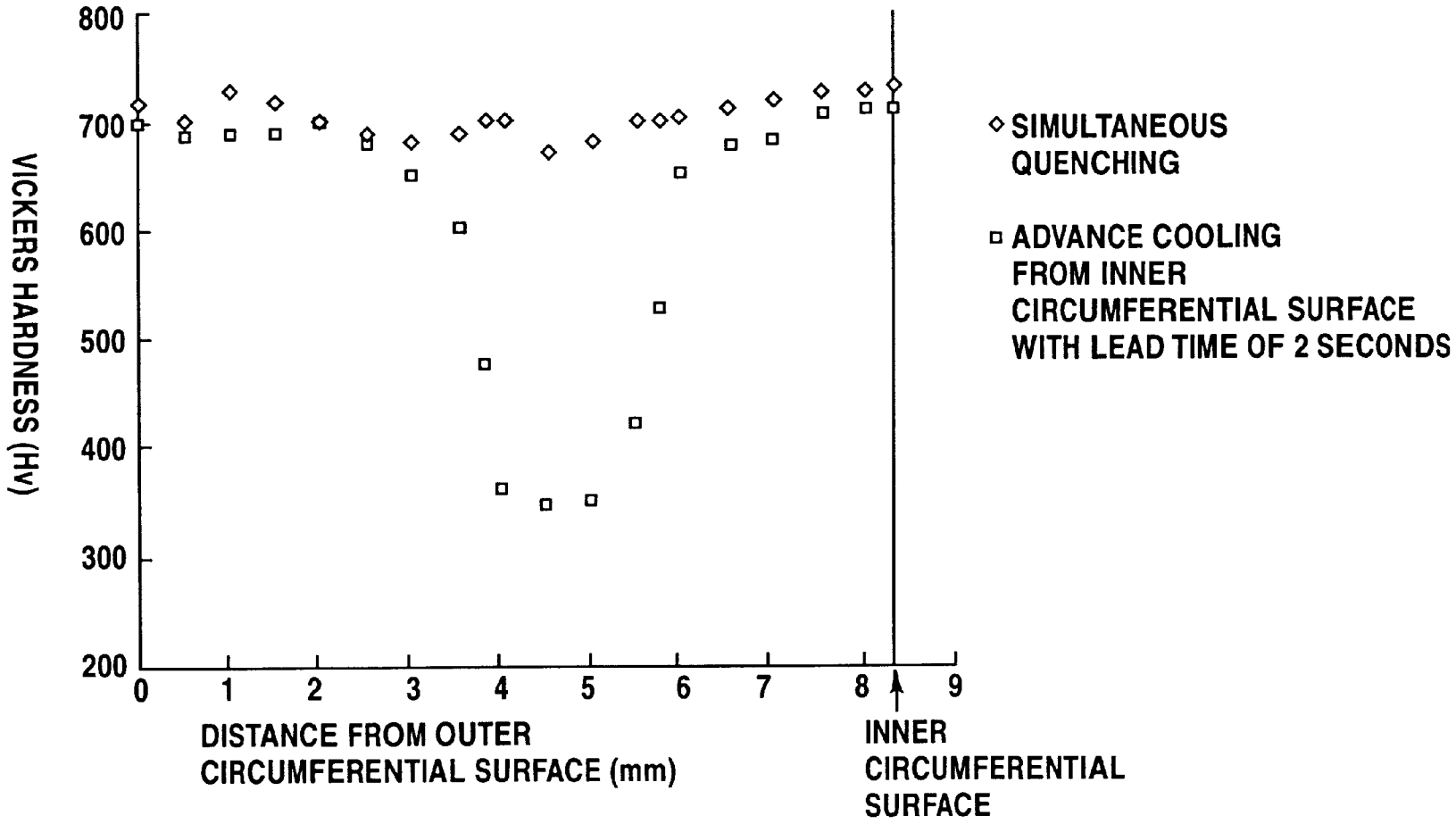
FIG. 13 is a graph showing the distributions of hardness in bushings having the dimension A and the composition No. 7 and treated by the time difference hardening.
Figure 14:
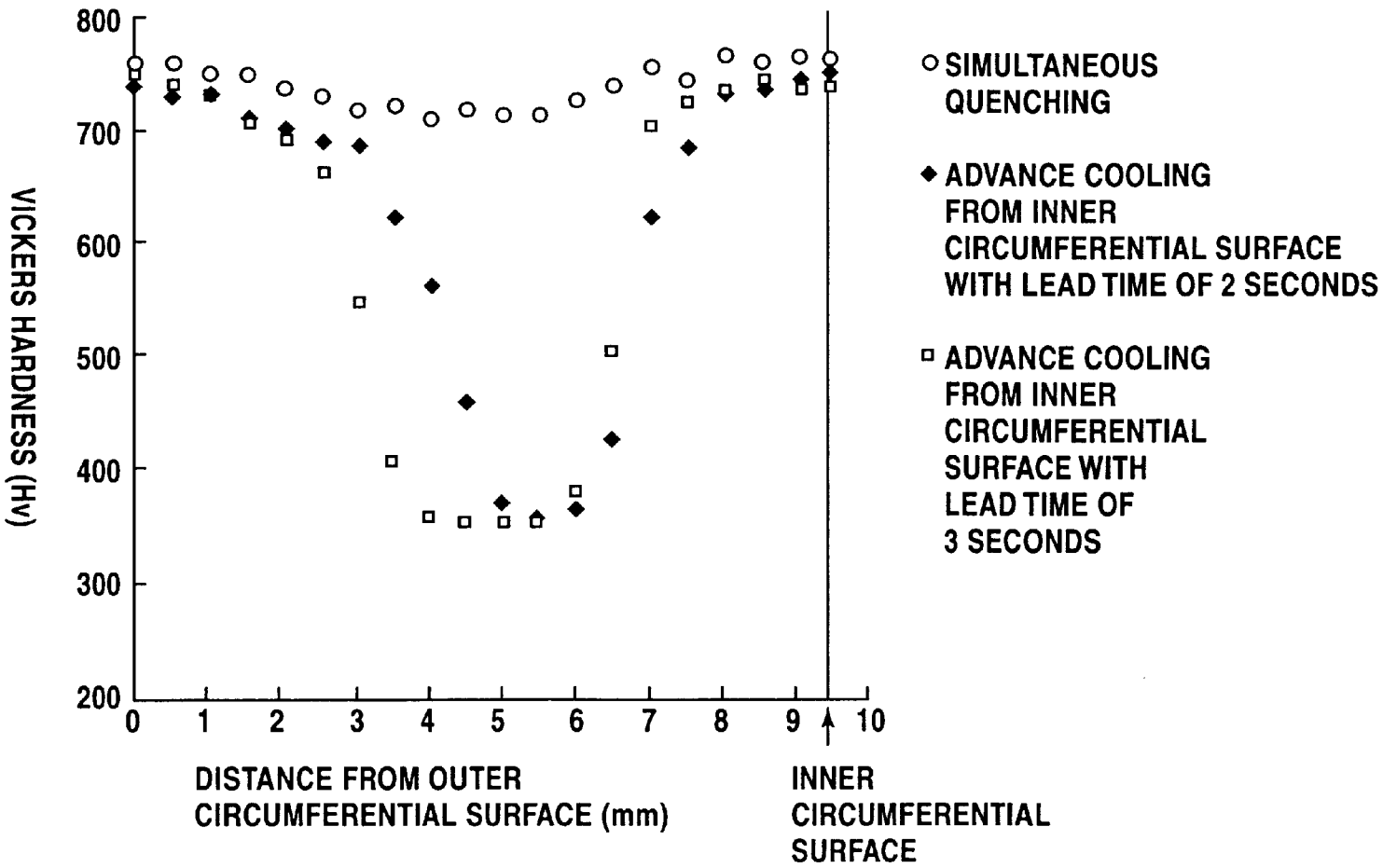
FIG. 14 is a graph showing the distributions of hardness in bushings having the dimension B and the composition No. 8 and treated by the time difference hardening.
Figure 15:
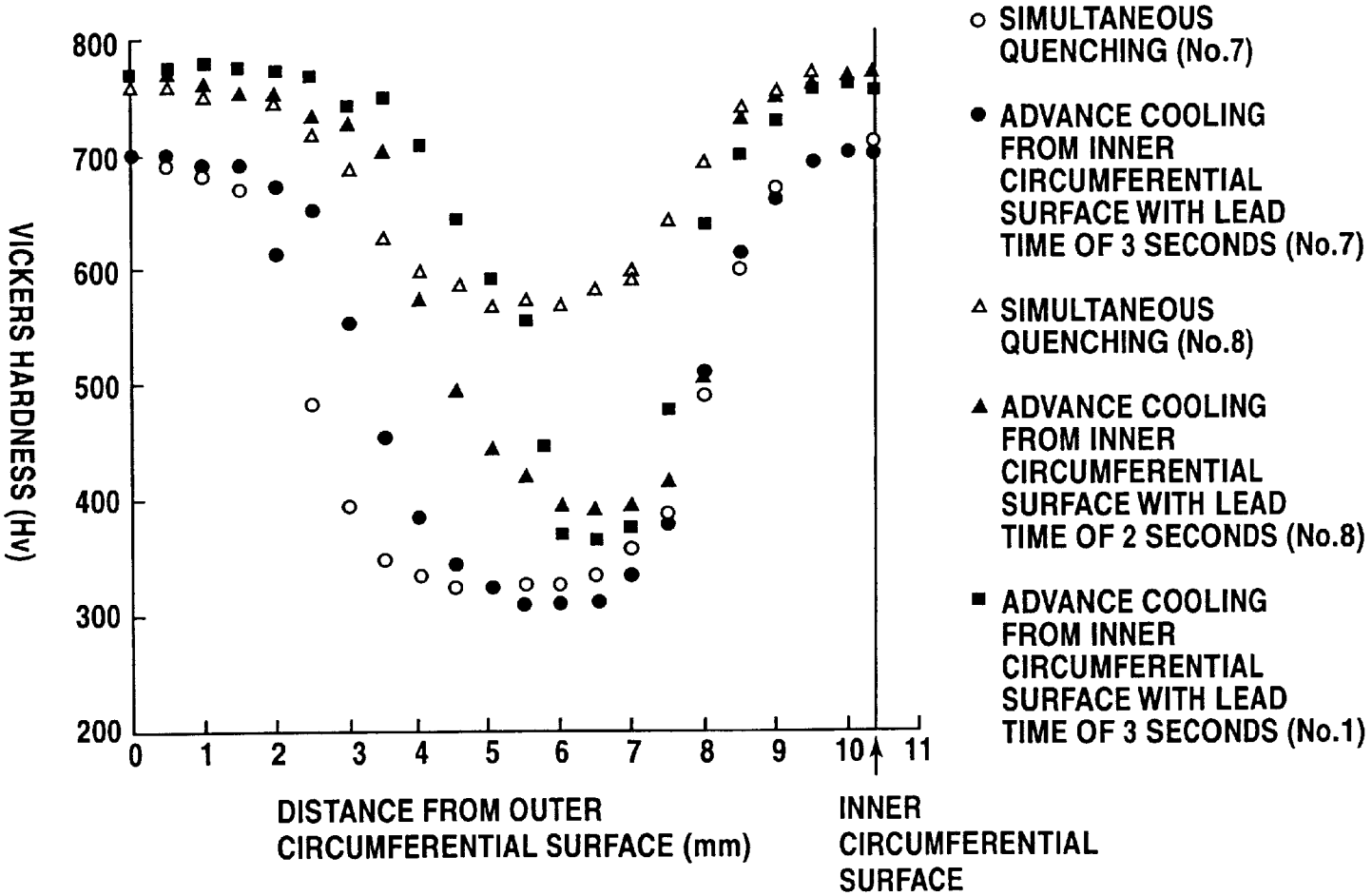
FIG. 15 is a graph showing the distributions of hardness in bushings having the dimension C and the composition Nos. 7, 8 and treated by the time difference hardening.
Figure 16:
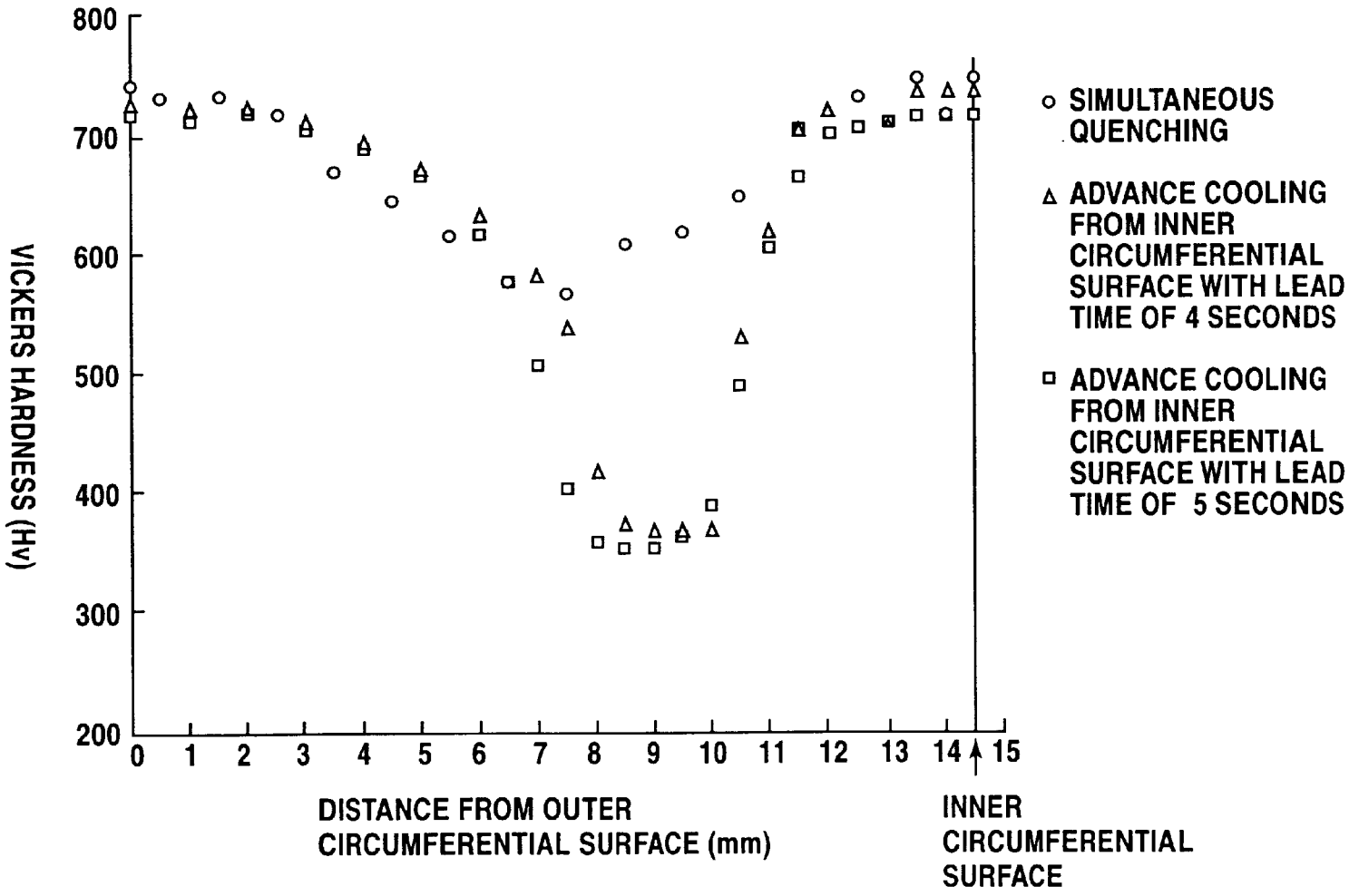
FIG. 16 is a graph showing the distributions of hardness in bushings having the dimension D and the composition No. 2 and treated by the time difference hardening.
Figure 17:
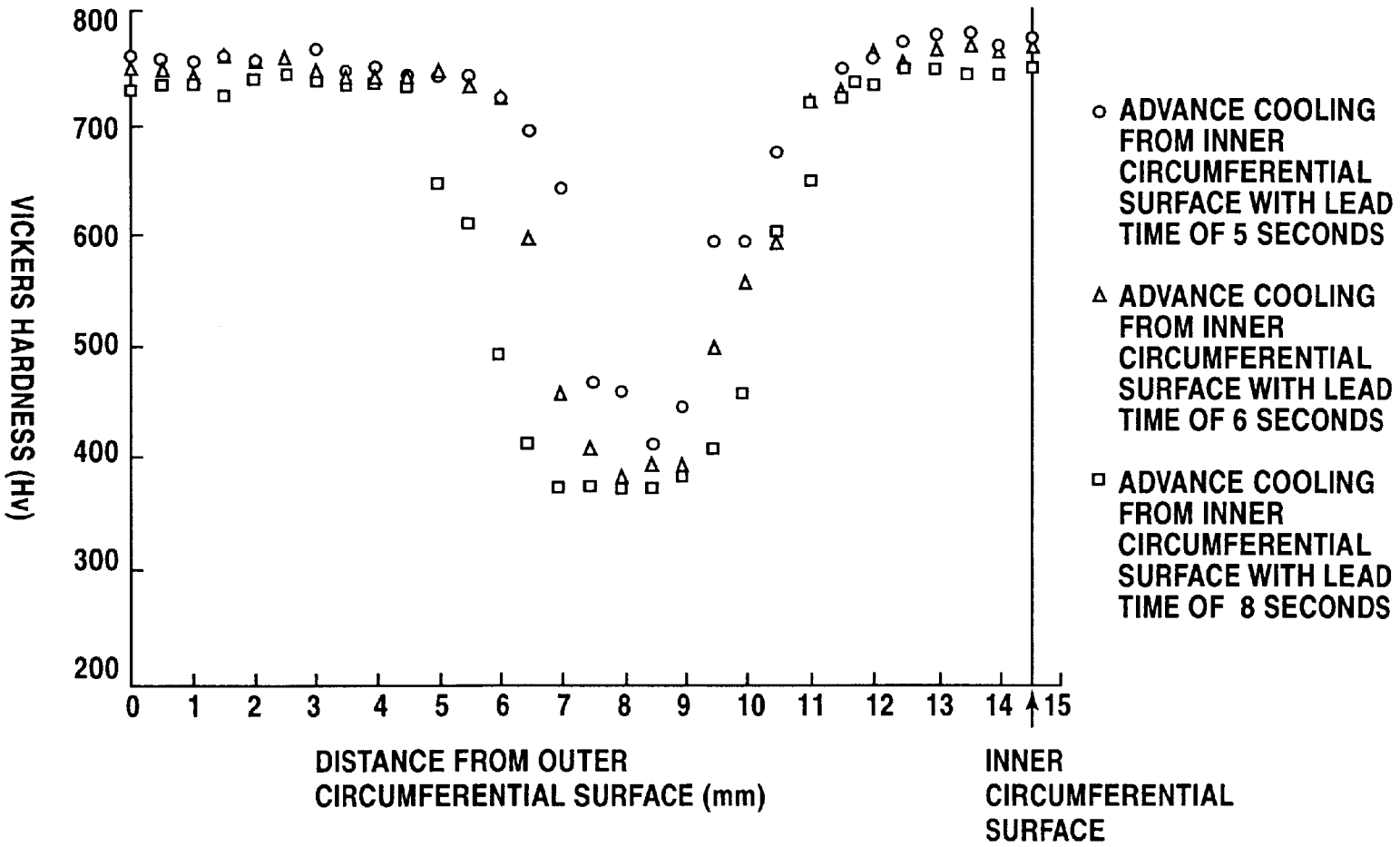
FIG. 17 is a graph showing the distributions of hardness in bushings having the dimension D and the composition No. 3 and treated by the time difference hardening.
Figure 18:
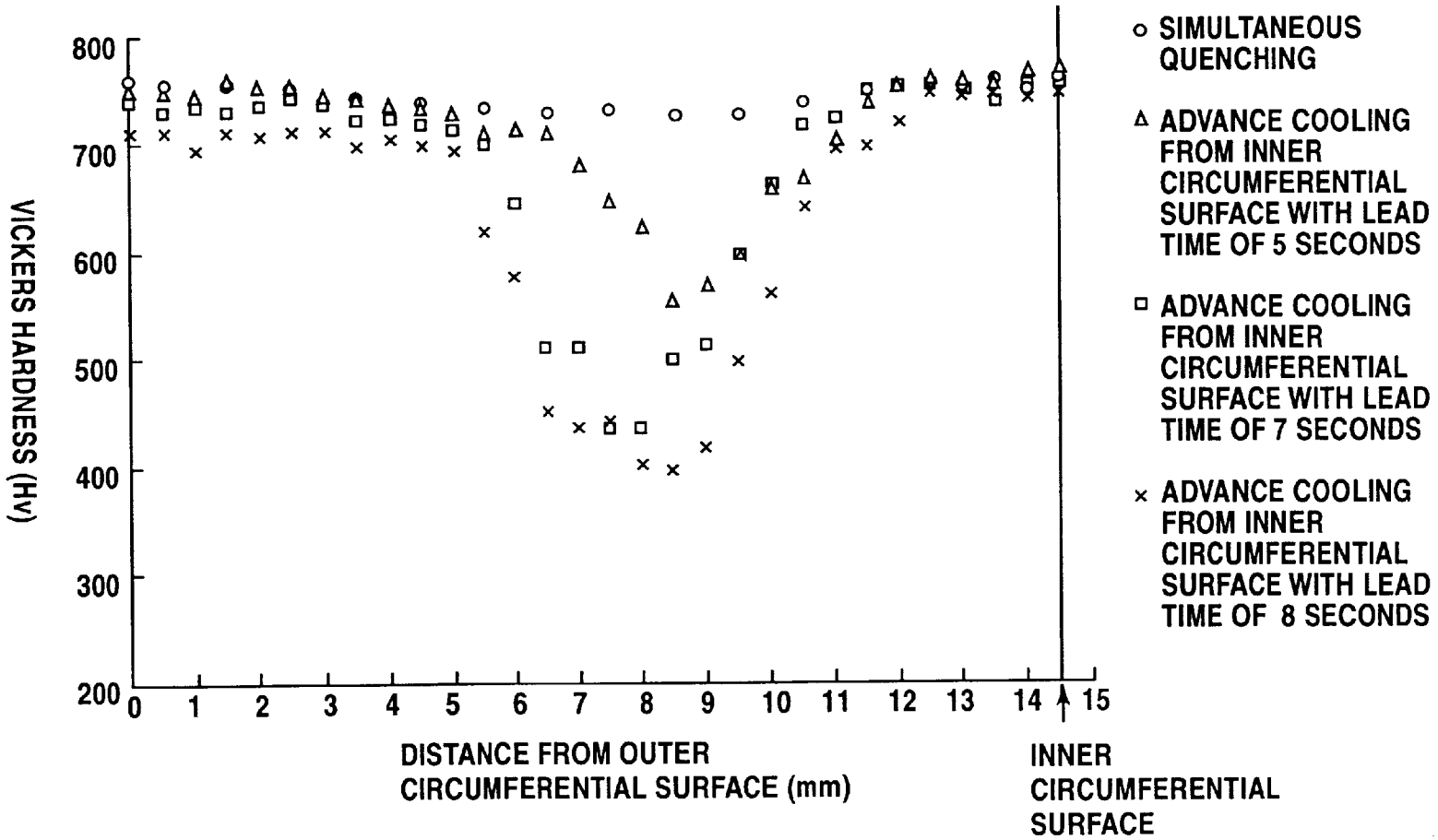
FIG. 18 is a graph showing the distributions of hardness in bushings having the dimension D and the composition No. 4 and treated by the time difference hardening.

FIG. 7 shows the relationship between the degree of through hardening and the frequency of quenching crack when the crawler belt bushings (Dimension D) manufactured from the steel materials Nos. 1 to 4 were quenched by simultaneous cooling from the inner and outer circumferential surfaces. Surface residual stress is plotted as the ordinate while the gradient of hardness in the outer circumferential surface as the abscissa. FIG. 7 also indicates the number of bushings out of 10 bushings, in which quenching crack occurred. As seen from this figure, no quenching crack occurred in the bushing made of the steel No. 1 and having a soft layer at its core whereas quenching crack occurred in the completely through-hardened bushings made of the steels Nos. 3 and 4. It is understood from these results that the frequency of quenching crack increases with the degree of through hardening.

FIGS. 8 to 12 show the distributions of hardness in the cross sections of the crawler belt bushings (Dimension D) produced from the steel materials Nos. 1, 2, 4, 5 and 6 when inner circumferential surface cooling and outer circumferential surface cooling were started at the same time and when inner circumferential surface cooling was started in advance of outer circumferential surface cooling. In the figures, the number of bushings having quenching cracks per 10 bushings (crack ratio) is indicated, from which it is understood that quenching crack can be perfectly prevented by starting inner circumferential surface cooling 2 seconds before outer circumferential surface cooling. The lead time for preventing quenching crack is thought to be dependent on the thickness of a crawler belt bushing to be treated. For instance, it has been found that quenching crack can be prevented in a small-sized crawler belt bushing (Dimension A) having a thickness of 8.3 mm, by setting the lead time to about 1 second.

The bushing made of the steel No. 6 containing 1.34 wt % carbon was through hardened and perfectly prevented from quenching crack by starting inner circumferential surface cooling 8 seconds before outer circumferential surface cooling. As understood from FIGS. 10 to 12, the hardness of the outer circumference surface hardened layer is 700 to 850 Hv, which is equal to or more than those of crawler belt bushings treated by carburization heating and therefore it is obvious that the wear resistance of the outer circumference of the bushing has been significantly improved. Also, quenching crack was checked when the crawler belt bushing (Dimension D) manufactured from the steel No. 4 was quenched by starting outer circumferential surface cooling in advance of inner circumferential surface cooling. In this case, quenching crack was prevented substantially similarly to the case of quenching of the bushing No. 6 by firstly starting inner circumferential surface cooling.

FIGS. 13 to 18 show the distributions of hardness in the cross sections of bushings having the respective dimensions when inner circumferential surface cooling and outer circumferential surface cooling were started at the same time and when inner circumferential surface cooling was started in advance of outer circumferential surface cooling.

The following is understood from the results of the above tests.

(1) Even when treating a steel which is usually fully hardened at its core by simultaneously starting inner circumferential surface cooling and outer circumferential surface cooling, a soft layer can be formed within the core region at a cross-sectional position closer to the inner circumferential surface so as to form a U-shaped distribution of hardness, by utilizing the mass effect of the wall of the bushing obtained by employing different starting times for inner circumferential surface cooling and outer circumferential surface cooling. Therefore, the same effect can be expected by making the cooling power of the inner circumferential surface different from the cooling power of the outer circumferential surface, more specifically, by making the cooling power of the inner circumferential surface lower than that of the outer circumferential surface.

(2) It is understood, from the relationship between the degree of through hardening and the frequency of quenching crack with respect to the bushings having the dimension D, that bushings which are through hardened by the simultaneous cooling can be perfectly prevented from quenching crack by imparting hardness to the bushings so as to have a U-shaped distribution of hardness.

(3) Further, a steel, which is not usually through hardened by the simultaneous cooling, can be more deeply hardened by the effect of the increased cooling rate of the outer circumferential surface. The increase in the cooling rate can be achieved by reducing heat capacity in the core by the advance cooling from the inner circumferential surface and achieved by the later cooling from the outer circumferential surface.

Figure 19:
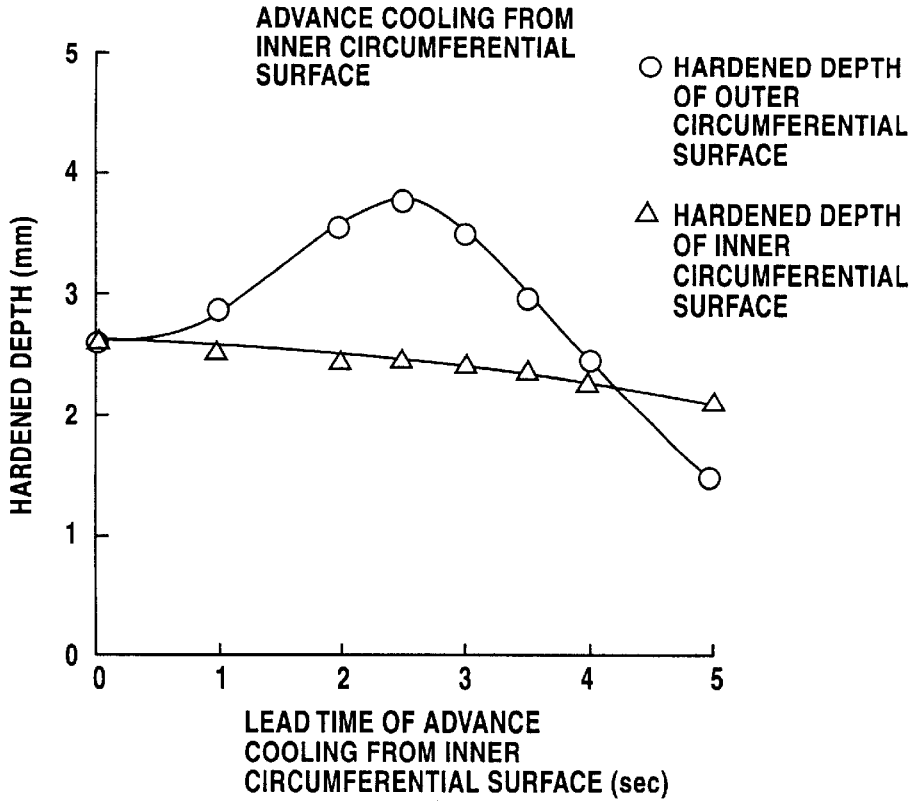
FIG. 19 is a graph showing the relationship between the hardened depths of the inner and outer circumferential surfaces of a bushing having the dimension C and the lead time of advance cooling from the inner circumferential surface.
Figure 20:
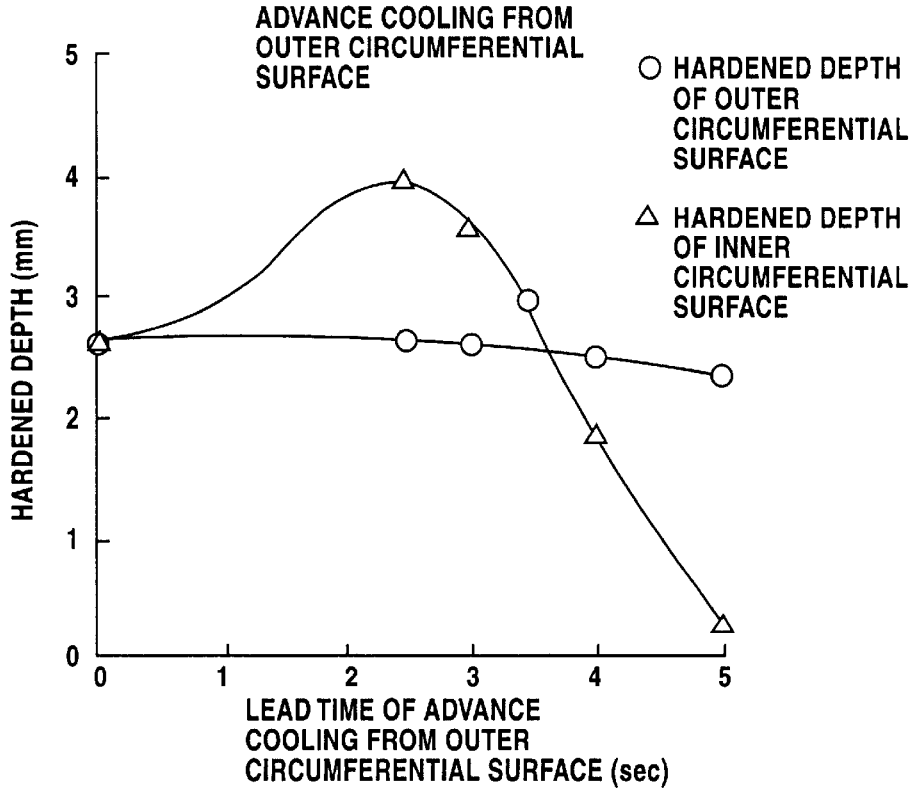
FIG. 20 is a graph showing the relationship between the hardened depths of the inner and outer circumferential surfaces of a bushing having the dimension C and the lead time of advance cooling from the outer circumferential surface.

FIG. 19 shows the relationship between the lead time of advance cooling from the inner circumferential surface and the hardened depths of the inner and outer circumferential surfaces of the bushing having the dimension C. It is understood from this figure that when the lead time is in a certain range, the maximum hardened depth of the outer circumferential surface is obtained. In view of wear life, it is preferable that the hardened depth of the outer circumferential surface be at least 1.1 times the hardened depth of the inner circumferential surface or more. As seen from the data shown in FIGS. 13 to 18, the maximum hardened depth of the outer circumferential surface in the invention is about twice the hardened depth of the inner circumferential surface. This means that excellent wear life can be achieved by the invention. FIG. 20 shows the relationship between the lead time of advance cooling from the outer circumferential surface and the hardened depths of the inner and outer circumferential surfaces of the bushing having the dimension C. Oppositely to the result shown in FIG. 19, the hardened depth of the inner circumferential surface can be increased by starting outer circumferential surface cooling in advance of inner circumferential surface cooling. This process is suitably used in the production of wear-resistant, strong pipe products having a bore for delivering earth/sand and slurry therethrough.

Although the hardened depth of the outer circumferential surface can be increased by the conventional heat treatment employing thermal refining and induction hardening in combination, this method needs to carry out thermal refining and induction hardening for each of the inner and outer circumferential surfaces, which is economically disadvantageous.

(Wear resistance test on crawler belt bushings)

Figure 21:
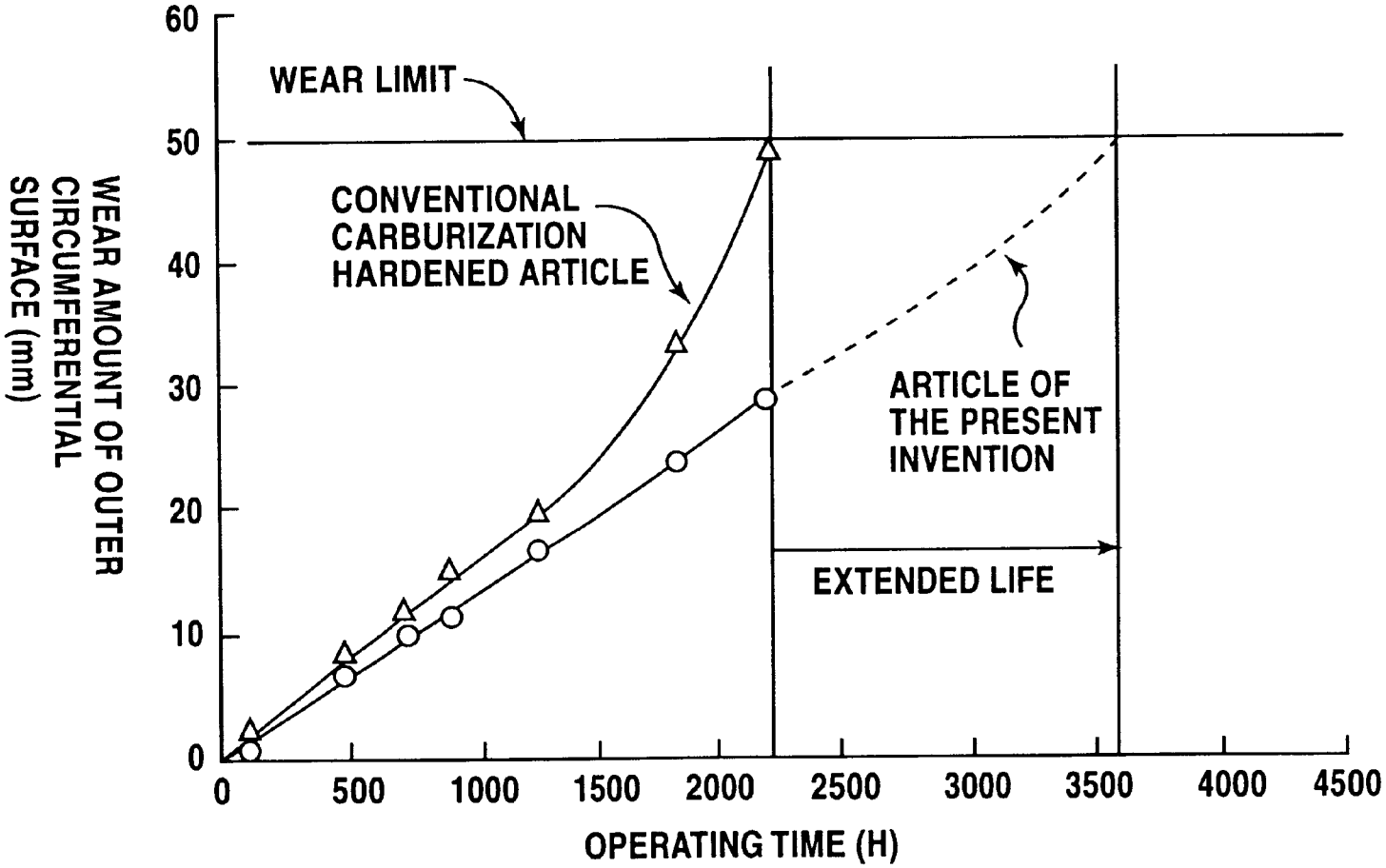
FIG. 21 is a graph showing test results relating to the wear of the outer circumferences of bushings in service.

A crawler belt bushing (Dimension C; Composition No. 8; the hardened depth of the outer circumferential surface= 5.3 mm) treated by the process according to Example 1 and a conventional carburized bushing (Dimension C; quality SCR420H; hardened depth=2.4 mm) were respectively mounted on a crawler belt (D50, produced by Komatsu) of a bulldozer and used in soil dressing in a rice field. FIG. 21 shows the results of the wear tests. After 2,200 hour operation, the conventional bushing was worn by 5 mm, whereas the bushing according to the invention was worn by 2.8 mm.

It took about 3,600 operating hours for the bushing of the invention to reach the critical wear amount of 5 mm, which is a considerable improvement in wear life. When considering the fact that the critical wear amount is about one half the thickness of a bushing and that the hardened layer of the outer circumferential surface formed by the thermal treatment of the invention reaches the substantial core region as seen from FIGS. 13 to 18, the invention has brought about a considerable improvement in wear life. The test specimen of the invention has high hardness in the outer circumferential surface hardened layer (see FIG. 15) and therefore a low wear rate in the hardened layer, compared to the conventional carburized bushing, so that it has proved to be excellent in wear resistance.

(Collapse fatigue test on crawler belt bushings)

FIG. 22 illustrates a method for testing collapse fatigue. A bushing having the configuration shown in FIG. 6 was forced into a crawler belt link 8 and a load F that was about twice the weight of the vehicle was repeatedly imposed on a specified position (20 mm away from the end face of the link in this example) to check the number of repetitions, that is, how many times the load was imposed until the bushing was brought to breakage. FIG. 23 shows the number of repetitions which brought the bushing to breakage when loads of 2 to 37.5 tons were applied to the bushings having the dimension C prepared according to this example. Three bushings, that is, the above conventional carburized bushing, the bushing treated by the time difference quenching of the invention, and the bushing treated by the simultaneous quenching were compared in terms of fatigue strength. It is apparent from the comparison that the bushing according to the invention exhibits higher fatigue strength than the conventional carburized bushing. Similar comparison was made using large-sized specimens having the dimension D, from which it was found that the bushing treated by the time difference quenching of the invention was superior in fatigue strength to the conventional carburized bushing and to the non-through-hardened bushing treated by the simultaneous quenching.

(Impact fatigue test)

Figure 24:
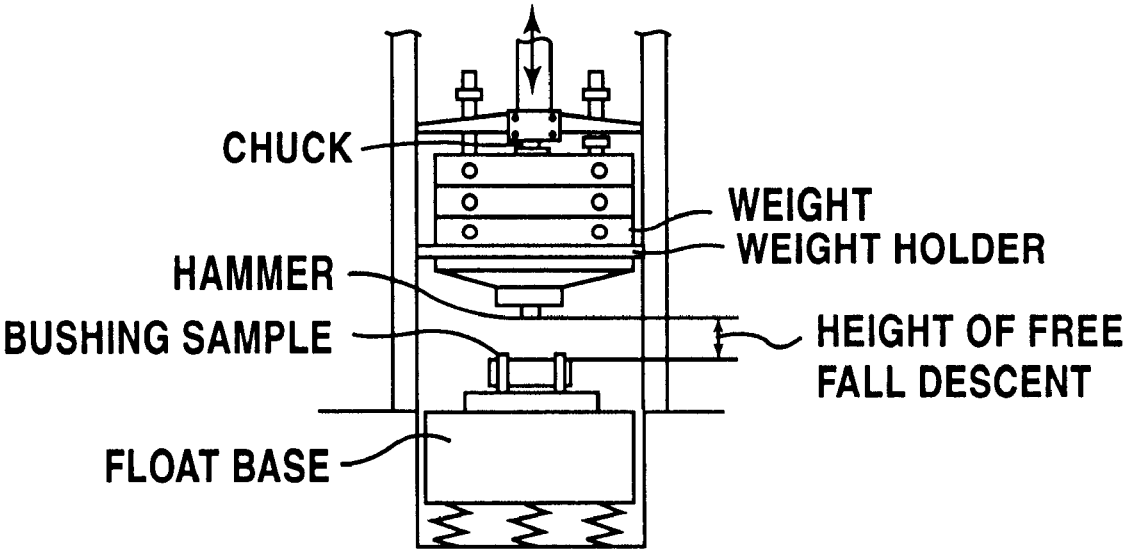
FIG. 24 shows a method for testing impact fatigue.

FIG. 24 shows a method for testing impact fatigue strength. The crawler belt bushing treated by the thermal treatment according to Example 1 was forced into a crawler belt link and repeatedly struck with a hammer, causing impact load so that the stresses exerted on the inner circumferential surface of the bushing were to two, three, and four times the weight of the vehicle. The number of repetitions which brought the bushing to breakage was checked to measure its impact fatigue properties. For comparison, a specimen (Vickers Hardness Hv=about 280) was prepared in the following way: A bushing manufactured from a SCrB440H boron steel was thermally refined (oil quenching at 850° C. and tempering at 500° C. for 3 hours) and after induction hardening, the bushing was tempered at 180° C. for 3 hours, thereby obtaining a hardened depth of about 3.5 mm at the inner and outer circumferential surfaces.

Figure 25:
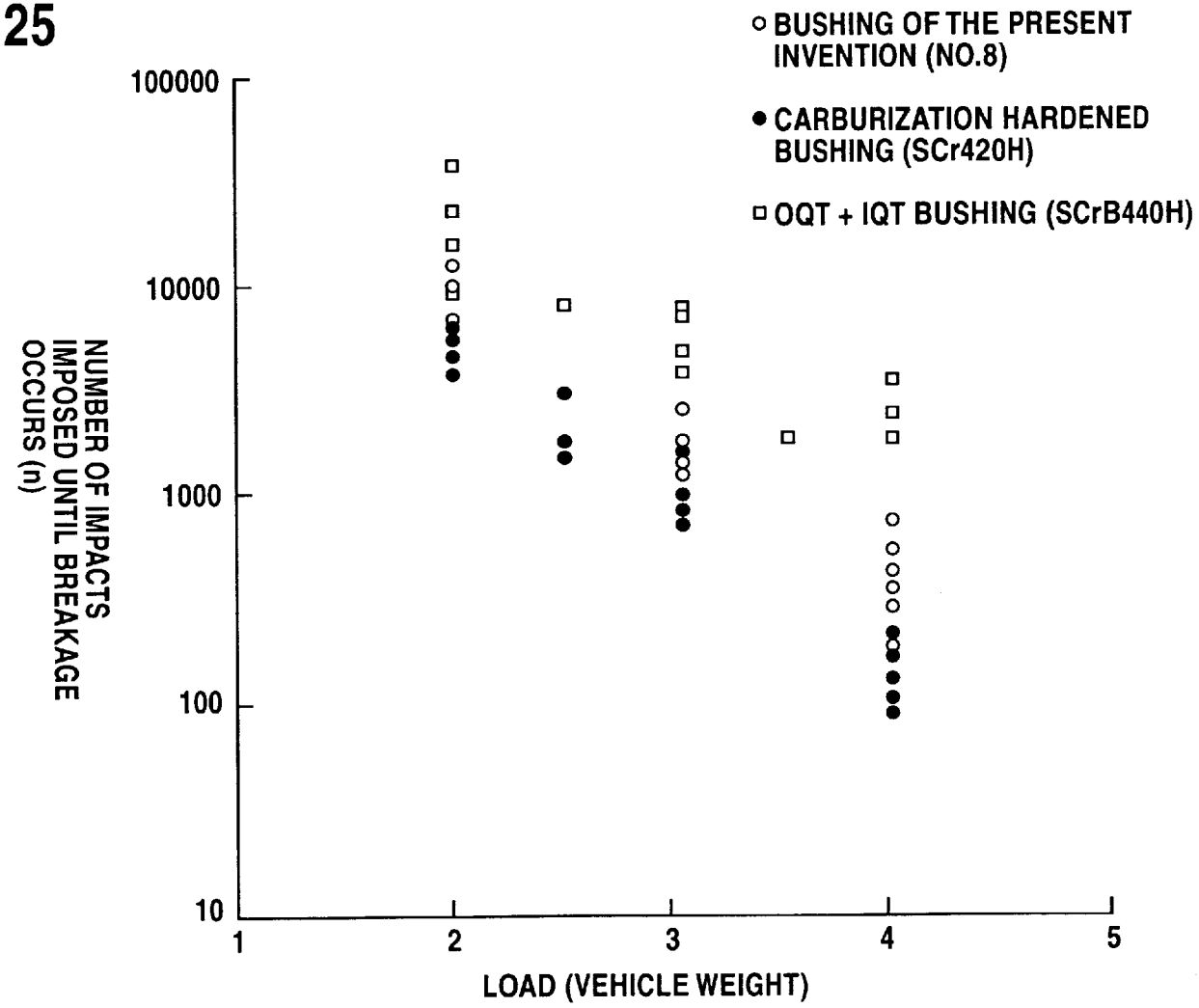
FIG. 25 is a graph (1) showing the results of impact fatigue tests.
Figure 26:
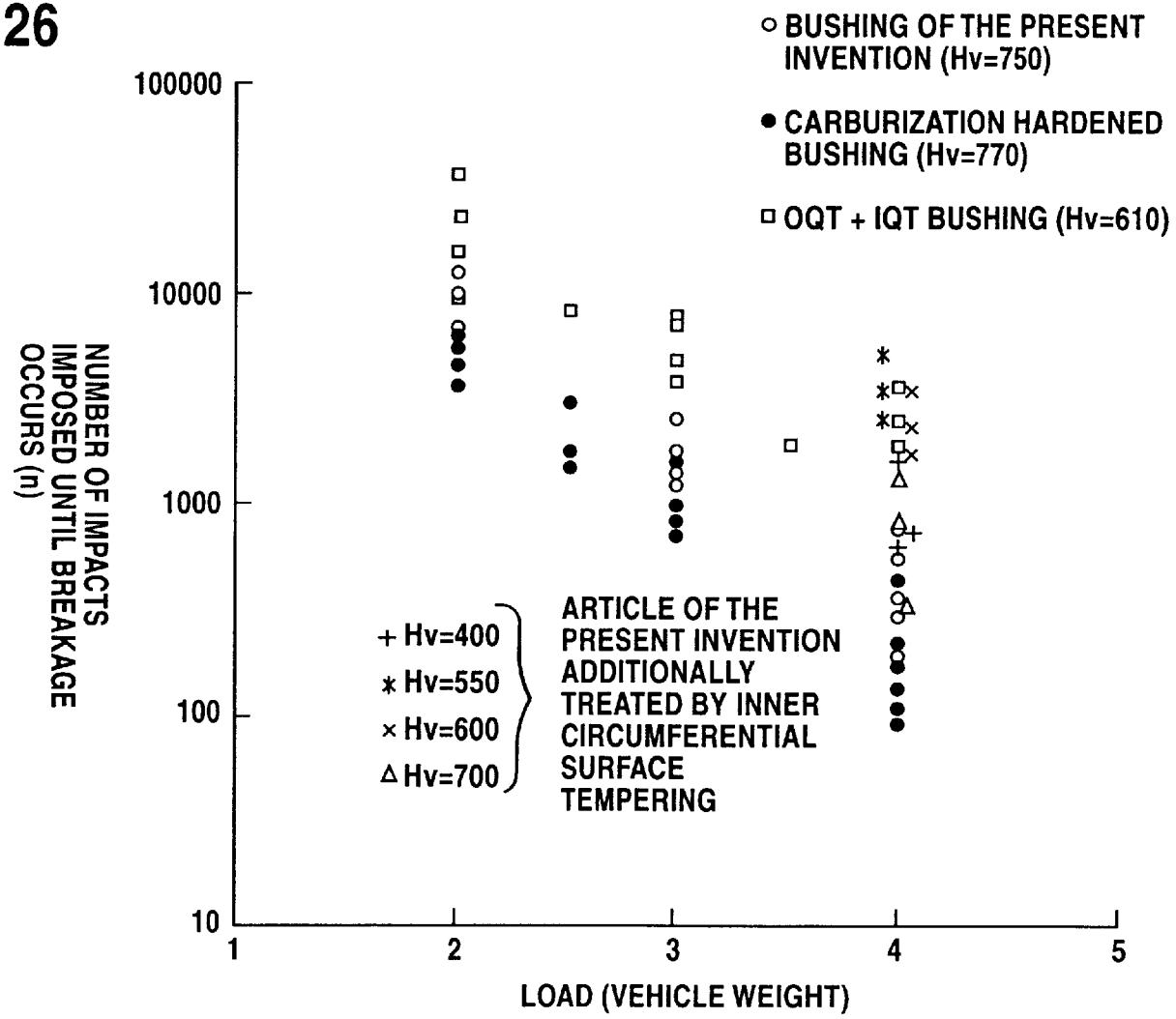
FIG. 26 is a graph (2) showing the results of impact fatigue tests.

FIG. 25 shows the results of the measurements. It is apparent from this figure that the bushings according to the invention are improved in impact strength over the conventional carburized bushings. Probably, this is attributable to the facts that a grain boundary layer or imperfectly hardened layer exists in the inner circumferential surface of the conventional carburized bushings and that the carburized bushings have higher surface carbon content (about 0.8 wt %) and higher surface hardness. This means that the impact fatigue strength of the bushing of the invention can be increased by adjusting the hardness of the inner circumferential surface to increase toughness. FIG. 26 shows the relationship between the hardness of the inner circumferential surface and the number of impact ruptures when the bushing of the invention was induction tempered from the inner circumferential surface. As apparent from the figure, when the surface hardness Hv is 550 to 600, the optimum strength can be obtained. For example, when the bushing of the invention has a surface hardness Hv of 400, it has higher strength than the conventional carburized bushing, but excessive distortion occurred at the inner circumference of the bushing after the test. This distortion may cause interference with crawler belt pins, resulting in galling and abrasion. Therefore, the hardness Hv for the invention is preferably 450 or more. The upper limit of hardness for the invention is not particularly specified by the comparison with the conventional carburized bushing, but may be as high as the surface hardness of the carburized bushing (Hv=up to 750). However, in order to achieve the optimum impact strength properties, the hardness Hv of the inner circumferential surface of the invention is preferably limited to about 650.

EXAMPLE 2

Figure 3:
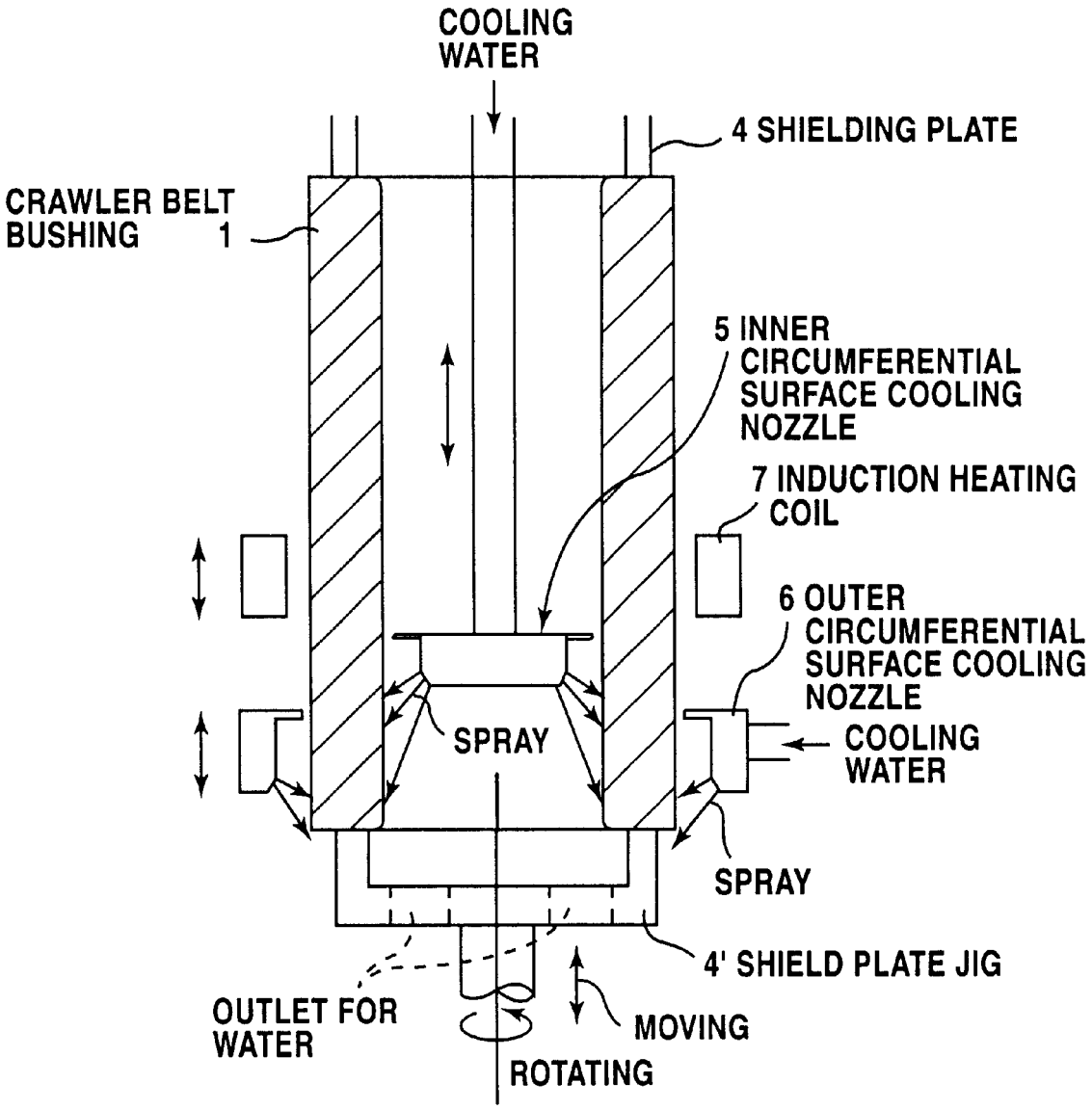
FIG. 3 is a sectional view of a hardening system employing induction heating coils.
Figure 4:
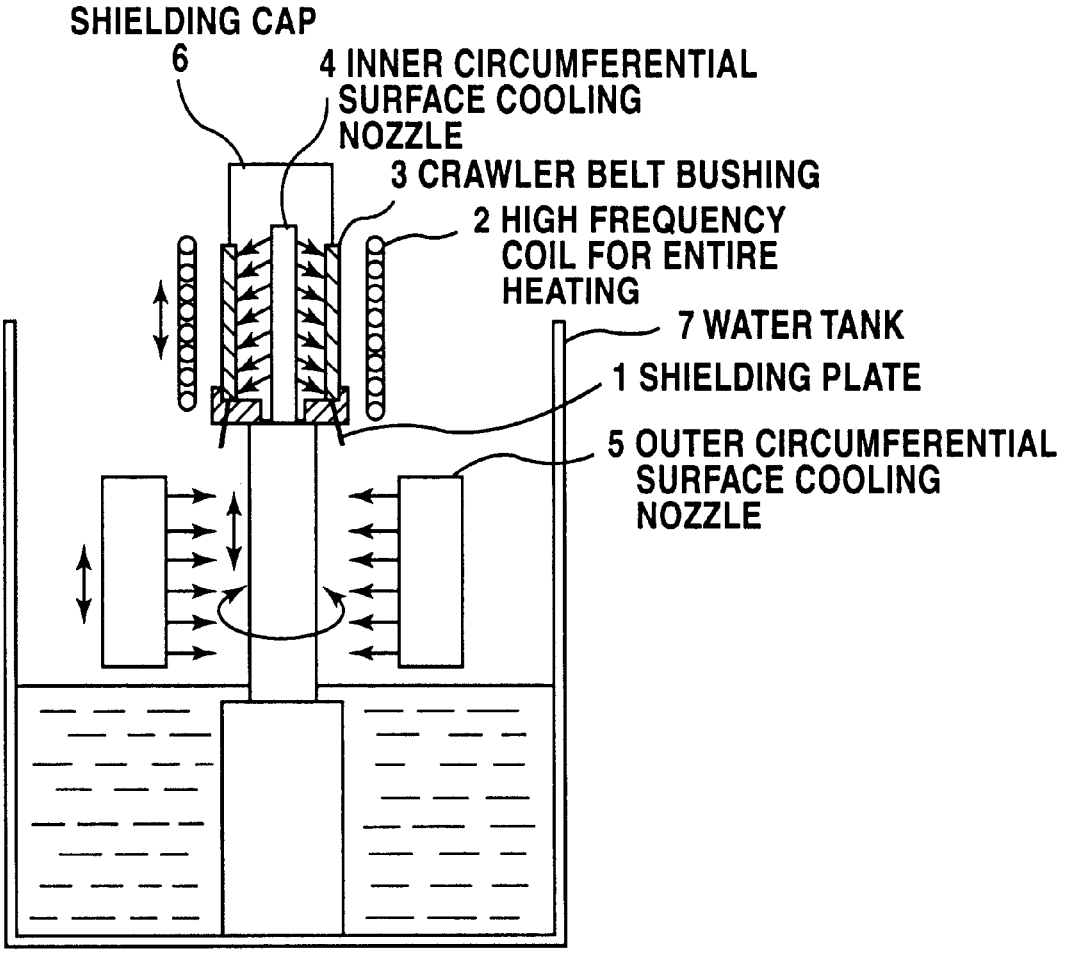
FIG. 4 is a schematic general view of an entire heating induction hardening system.

A bushing was hardened under the hardening conditions shown in TABLE 3, using the hardening system shown in FIG. 3. The dimension and composition of the bushing used in this example were D, and No. 3 (the steel of No. 3 is usually through hardened by simultaneous quenching from the inner and outer circumferential surfaces), respectively. The difference between the position of the inner circumferential surface of the bushing upon which cooling water from the inner circumferential surface cooling nozzle 5 strikes and the position of the outer circumferential surface upon which cooling water from the outer circumferential surface cooling nozzle 6 strikes was adjusted to 30 mm. When the moving speed was 5 mm/sec., the lead time of inner circumferential surface cooling was about 6 sec. Further, the temperature of the induction heating was adjusted so as to obtain a temperature of about 920° C. at the outer circumferential surface and a temperature of about 850° C. at the inner circumferential surface.

TABLE 3

INDUCTION HEATING SCAN QUENCHING CONDITIONS

| HEATING - QUENCHING CONDITIONS | |
|---|---|
| FREQUENCY (KHz) | 1 |
| OUTPUT (KW) | 85 |
| FEED RATE (mm/sec) | 5.0 |
| COOLING METHOD (INNER, OUTER) | WATER SPRAY |

Figure 27:
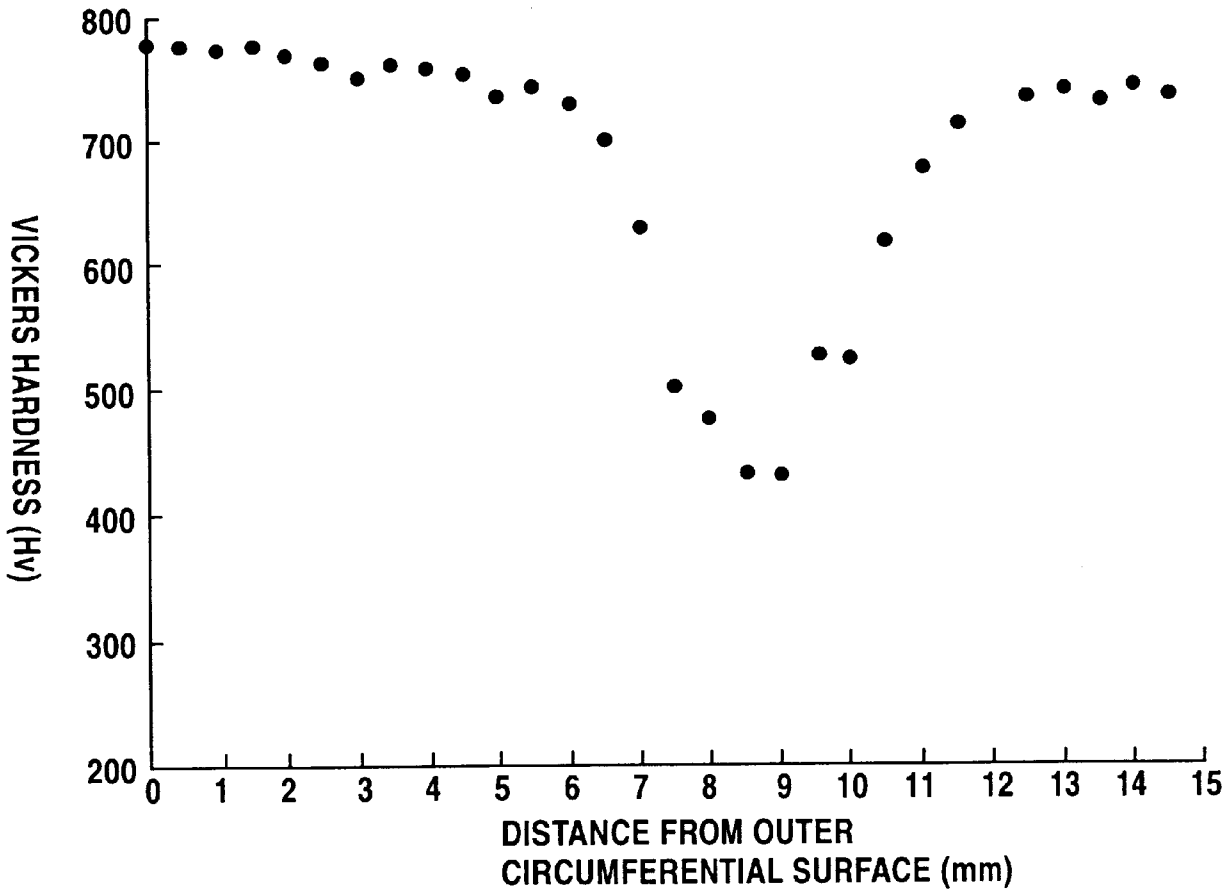
FIG. 27 is a graph showing the distribution of hardness in the wall cross section of a bushing tempered at 140° C. for one hour after the scan induction heating/time difference quenching.

FIG. 27 shows the distribution of hardness in the cross section of the bushing tempered at 140° C. for one hour after quenching. As seen from this figure, the hardened depth of the outer circumferential surface of the bushing according to this example is significant like Example 1 in which the time difference quenching is carried out after heating in a furnace and it is therefore understood that the bushing of this example has been improved in wear life.

Although the induction heating coil is disposed on the side of the outer circumferential surface of the bushing in this example, it may be disposed on the side of the inner circumferential surface of the bushing. However, it is preferable to carry out induction heating from the outer circumferential surface side, taking the operating performance of the hardening system into account.

EXAMPLE 3

Figure 5:
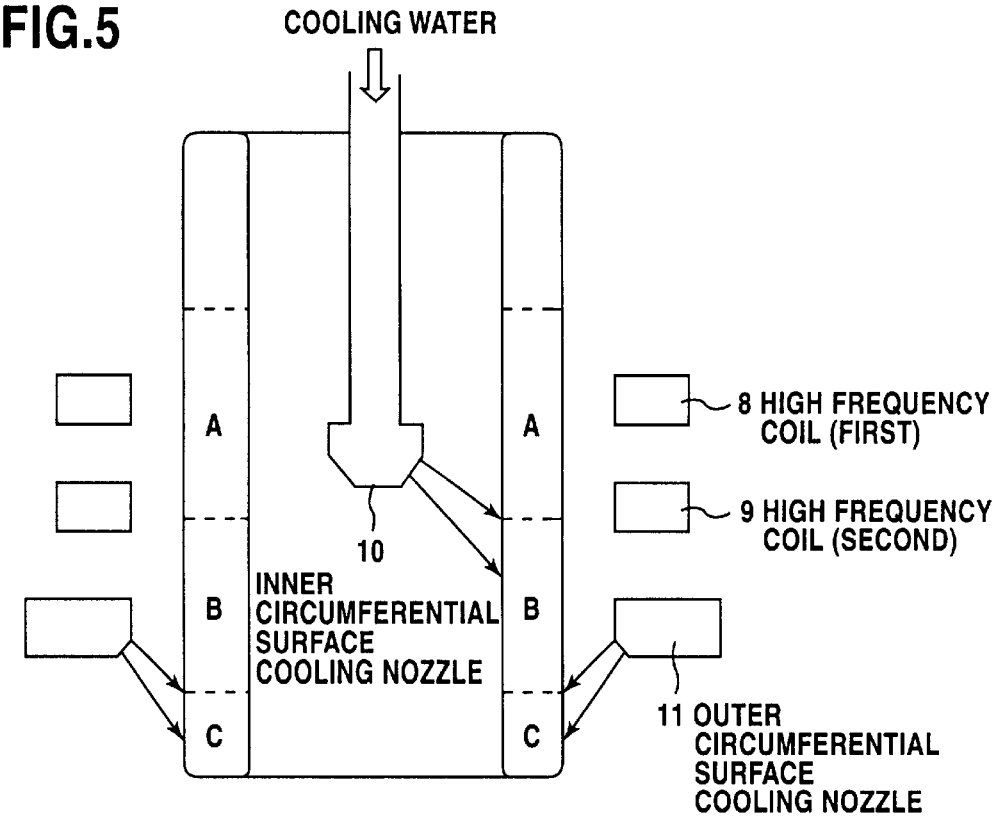
FIG. 5 is a schematic view of a scan induction hardening system.

TABLE 4 shows the steel compositions of the bushings used in Example 3. The bushings used in this example have the dimension C (see TABLE 2). The scan induction hardening system shown in FIG. 5 was employed in this example. This hardening system comprises two high frequency coils 8, 9 aligned vertically for heating the bushing from the outer circumferential surface side; a nozzle 10 for cooling the inner circumferential surface of the bushing; and a nozzle 11 for cooling the outer circumferential surface of the bushing. The scan heating/quenching is carried out by the relative movement of the bushing, coils 8, 9 and nozzles 10, 11 so that the treatment proceeds upwardly, starting from the lower part of the bushing. The inner circumferential surface nozzle 10 is designed to have an adequate jetting angle with respect a normal line to the inner circumferential surface in order to allow water present in the inner circumference to flow toward the lower portion of the bushing without being trapped. There is provided, near the lower end of the bushing, a shield plate for dividing a flow of cooling water used for inner circumferential surface cooling and a flow of cooling water used for outer circumferential surface cooling from each other. Disposed near the upper end of the bushing is a cap for dividing a flow of cooling water used for inner circumferential surface cooling and a flow of cooling used for outer circumferential surface cooling from each other. A high frequency power source of 6 KHz, giving an output of 50 KW was used and hardening tests were conducted with the output of about 27 to 32 KW. Some bushing specimens were subjected to low-temperature tempering at 140° C. for 3 hours after quenching. Some were subjected to entire induction heating from the outer circumference surface, using the same high frequency power source, and when the temperature of the inner circumferential surface has reached 850° C., inner circumferential surface cooling was started while continuing the induction heating. 6 seconds later, the heating was finished to start outer circumferential surface cooling.

TABLE 4

| No. | C | Si | Mn | Cr | Mo | P | S | Al |
|---|---|---|---|---|---|---|---|---|
| 4 | 0.61 | 0.19 | 1.17 | — | — | 0.018 | 0.018 | 0.037 |
| 11 | 0.75 | 0.18 | 0.61 | 1.02 | 0.16 | 0.010 | 0.012 | 0.028 |
| 12 | 1.45 | 0.28 | 0.58 | 0.82 | — | 0.009 | 0.008 | 0.031 |

Figure 28:
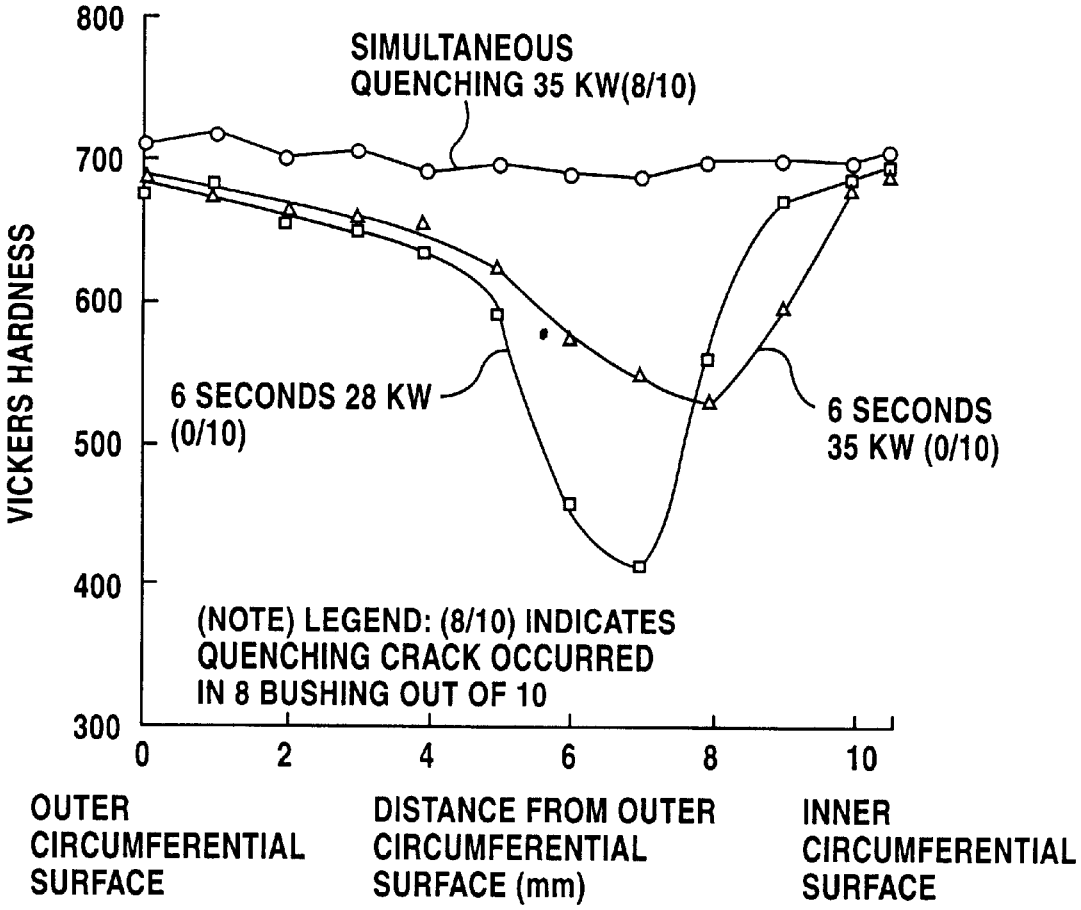
FIG. 28 is a graph showing the results of the scan induction hardening of bushings having the composition No. 4.
Figure 29:
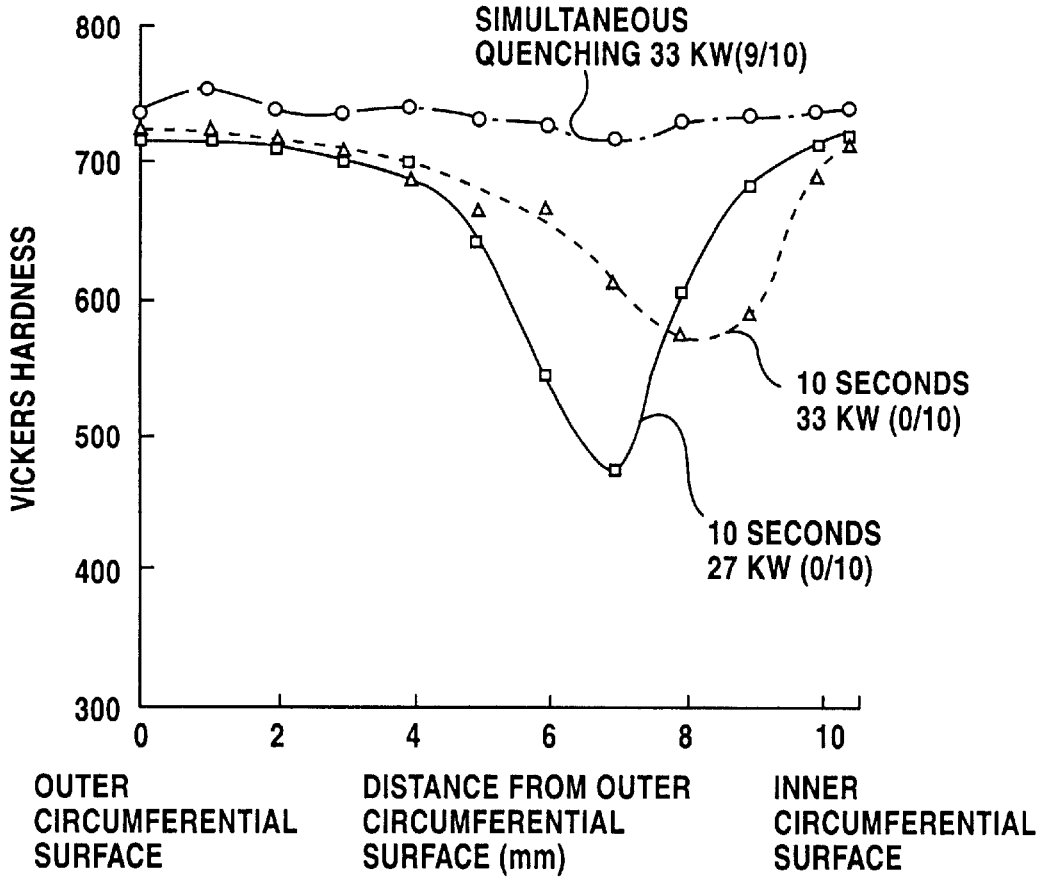
FIG. 29 is a graph showing the results of the scan induction hardening of bushings having the composition No. 11.
Figure 30:
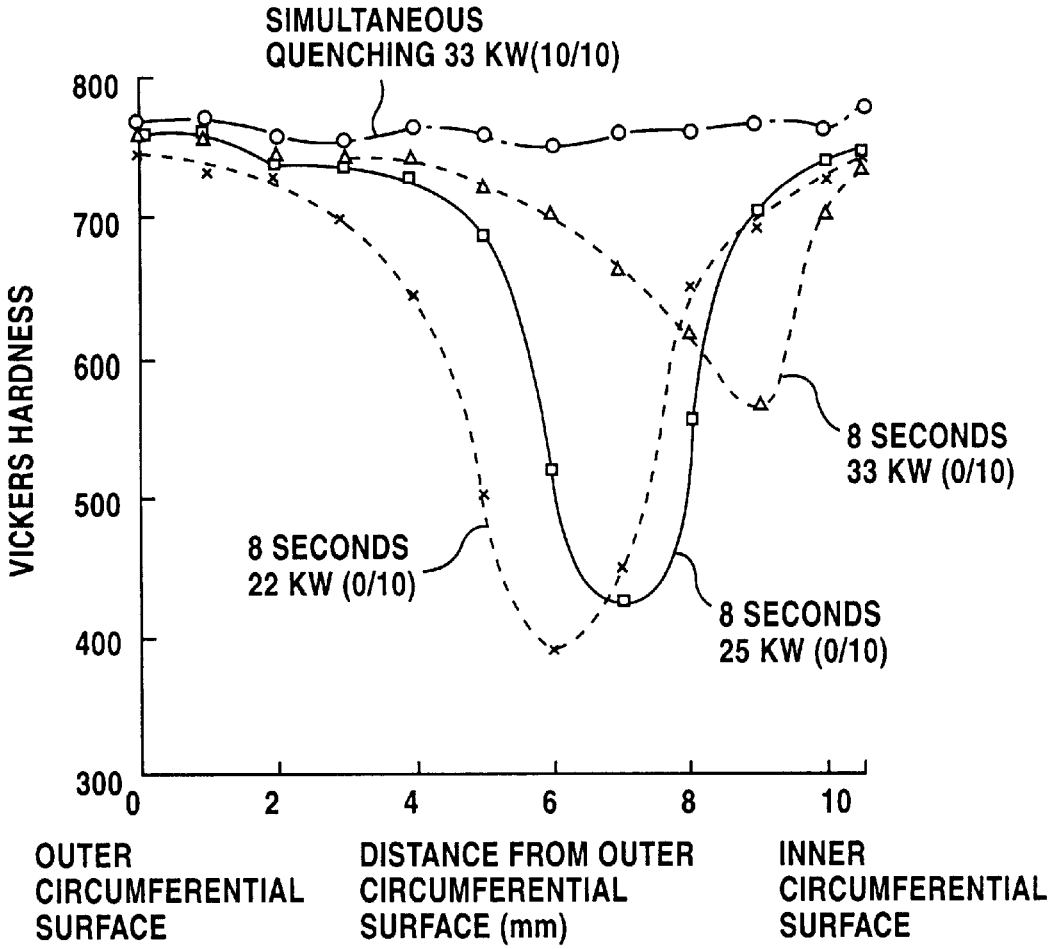
FIG. 30 is a graph showing the results of the scan induction hardening of bushings having the composition No. 12.

FIGS. 28 to 30 show the distribution of hardness in the cross sections of the crawler belt bushings manufactured from the steels Nos. 4, 11 and 12 (see TABLE 4) treated by the scan hardening, in the case where inner circumferential surface cooling and outer circumferential surface cooling are started at the same time and in the case where the inner circumferential surface is first cooled with the outer circumferential surface cooling nozzle being shifted downward, and 6 to 10 seconds later, outer circumferential surface cooling is started. It should be noted that the crawler belt bushings associated with FIG. 30 were thermally refined, by heating at 1,020° C. for 30 minutes, oil-quenching and then tempering at 600° C. for 1 hour.

The following facts are understood from the results of the above tests.

(1) Even when treating a steel which is usually hardened through its cross section by simultaneous quenching from the inner and outer circumferential surfaces, a soft layer can be formed within the core at a cross-sectional position closer to the inner circumferential surface so as to form a U-shaped distribution of hardness, by carrying out induction heating from the outer circumferential surface during the advance cooling, that is, the cooling from the inner circumferential surface.

(2) Steels, which are usually hardened through their cross sections by simultaneous quenching from the inner and outer circumferential surfaces, can be perfectly prevented from quenching crack by the hardening process of the invention so that steels having very high carbon content can be used for the bushings.

(3) Even when treating a steel, which is not usually hardened through its cross section by simultaneous quenching from the inner and outer circumferential surfaces, hardened depth can be increased by the effect of the increased cooling rate of the outer circumferential surface. The cooling rate of the outer circumferential surface is increased by reducing heat capacity in the core region through the advance cooling from the inner circumferential surface and by the later cooling from the outer circumferential surface.

(4) Since this example uses steels having high carbon content for the bushings, the hardness of the quench hardened layer of each bushing is substantially as high as the hardness of the carburized bushing. Further, the hardened layer of each bushing is deeper than that of the carburized bushing, and therefore it is understood that the bushings of this example have been considerably improved in wear life (the wear life of a bushing is evaluated by the time taken until about half thickness of the bushing has been worn away).

Figure 31:
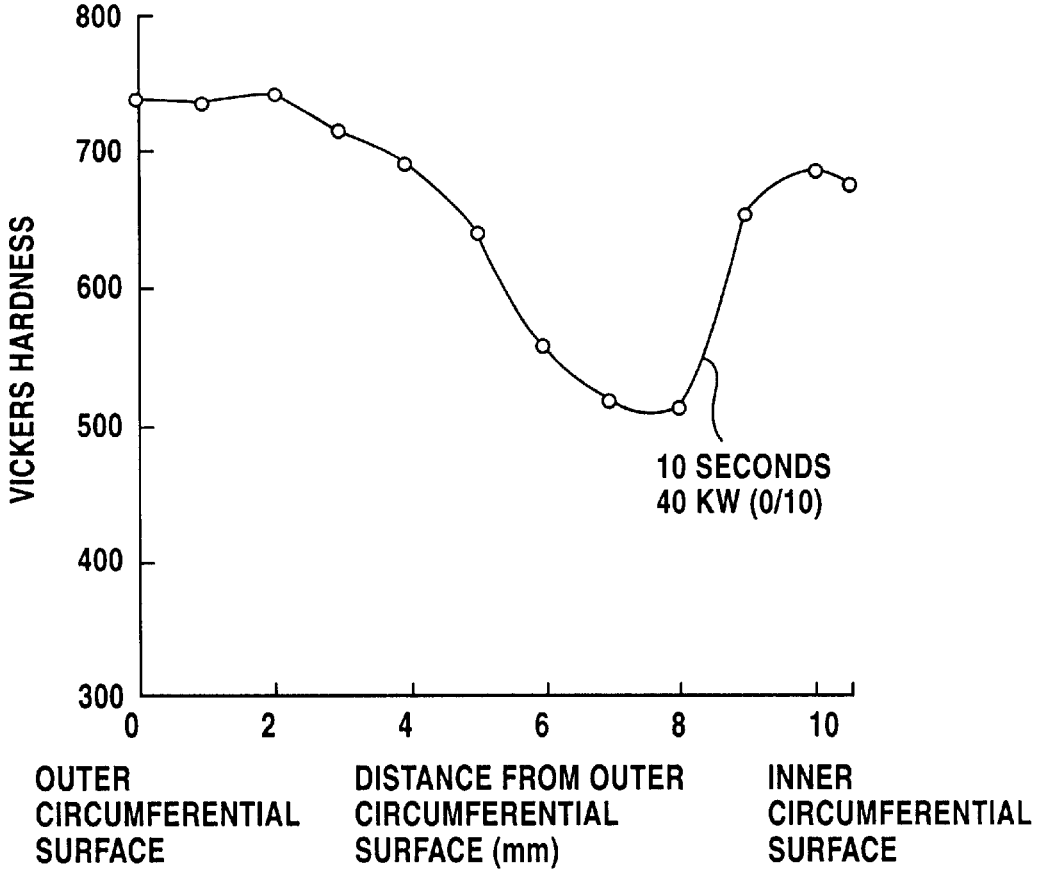
FIG. 31 is a graph (1) showing the result of the entire induction hardening of a bushing having the composition No. 11.

FIG. 31 shows the distribution of hardness in the cross section of the crawler belt bushing having the composition No. 11 when after entire induction heating, the inner circumferential surface was first cooled and 10 seconds later, the outer circumferential surface was cooled. The result shown in this figure is substantially similar to the data obtained from FIG. 29 and it is understood that quench hardened layers are formed in this bushing by the same heating/cooling mechanism as that of the scan hardening described earlier.

Figure 32:
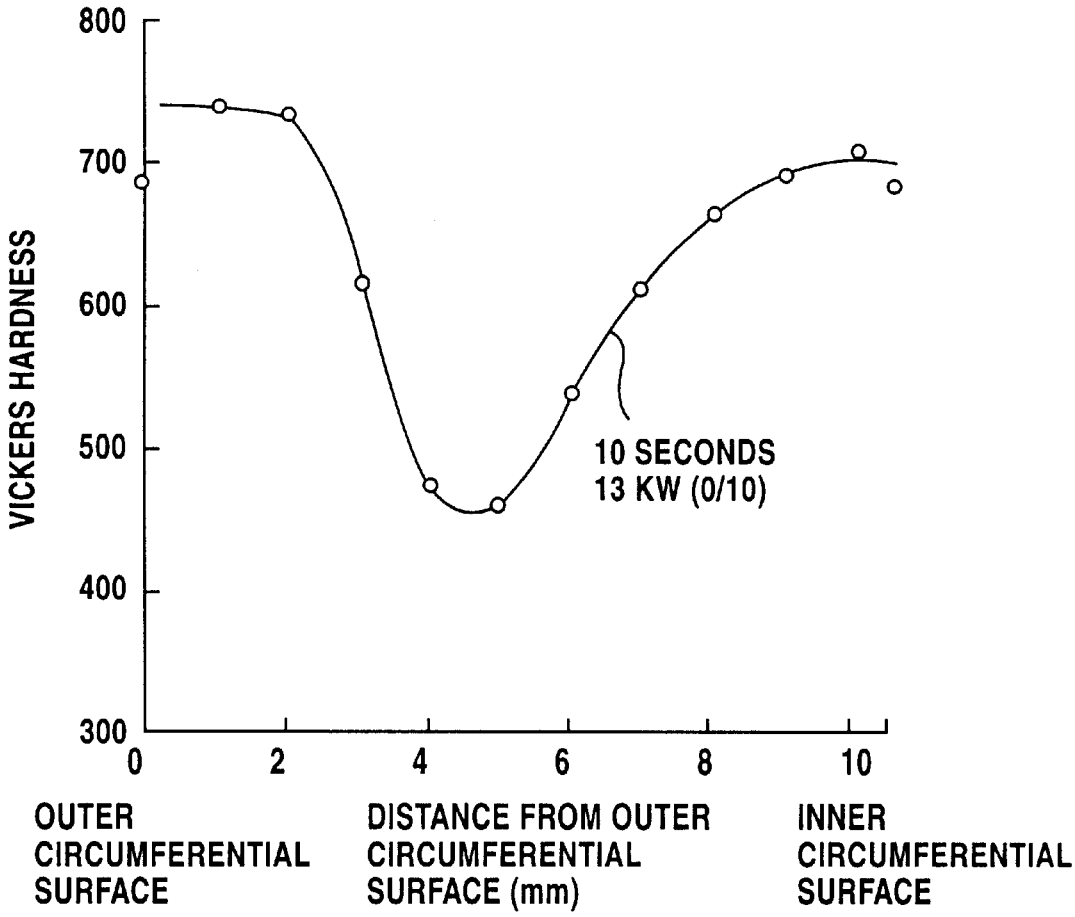
FIG. 32 is a graph (2) showing the result of the entire induction hardening of a bushing having the composition No. 11.

FIG. 32 shows the distribution of hardness in the cross section of the crawler belt bushing having the composition No. 11 when after entire induction heating, the inner circumferential surface was first cooled while heating the outer circumferential surface with heating power (13 KW) which was about one-third the heating power of the entire heating and 10 seconds later, the outer circumferential surface was cooled. In this case, the hardened depth of the inner circumferential surface could be increased, on the contrary to the result shown in FIG. 31. Such a bushing is suited for use in the production of wear-resistant, strong pipe products with a bore for delivering earth/sand and slurry therethrough.

(Impact fatigue test)

The crawler belt bushings were treated by the scan induction hardening of this example and then tempered at 180° C. for 3 hours. Then, these bushings were respectively forced into a crawler belt link and tested, using the impact fatigue tester shown in FIG. 24. Specifically, the bushings were repeatedly struck with a hammer, causing impact load so that the stresses exerted on the respective inner circumferential surfaces were equivalent to two, three, and four times the weight of the vehicle. The number of repetitions which brought each bushing to breakage was checked to measure the impact fatigue properties. For comparison, specimens were prepared in the following way: For preparing a specimen (Vickers Hardness Hv=about 280), a bushing manufactured from a SCrB440H boron steel was thermally refined (oil quenching at 850° C. and tempering at 500° C. for 3 hours) and then induction hardened to obtain a hardened depth of about 3.5 mm at the inner and outer circumferential surfaces. Another specimen was prepared by carburization-hardening a bushing made of SCr420H steel at 930° C., and then tempering it at 180° C. for 3 hours so as to obtain a hardened depth of 2.5 mm.

Figure 33:
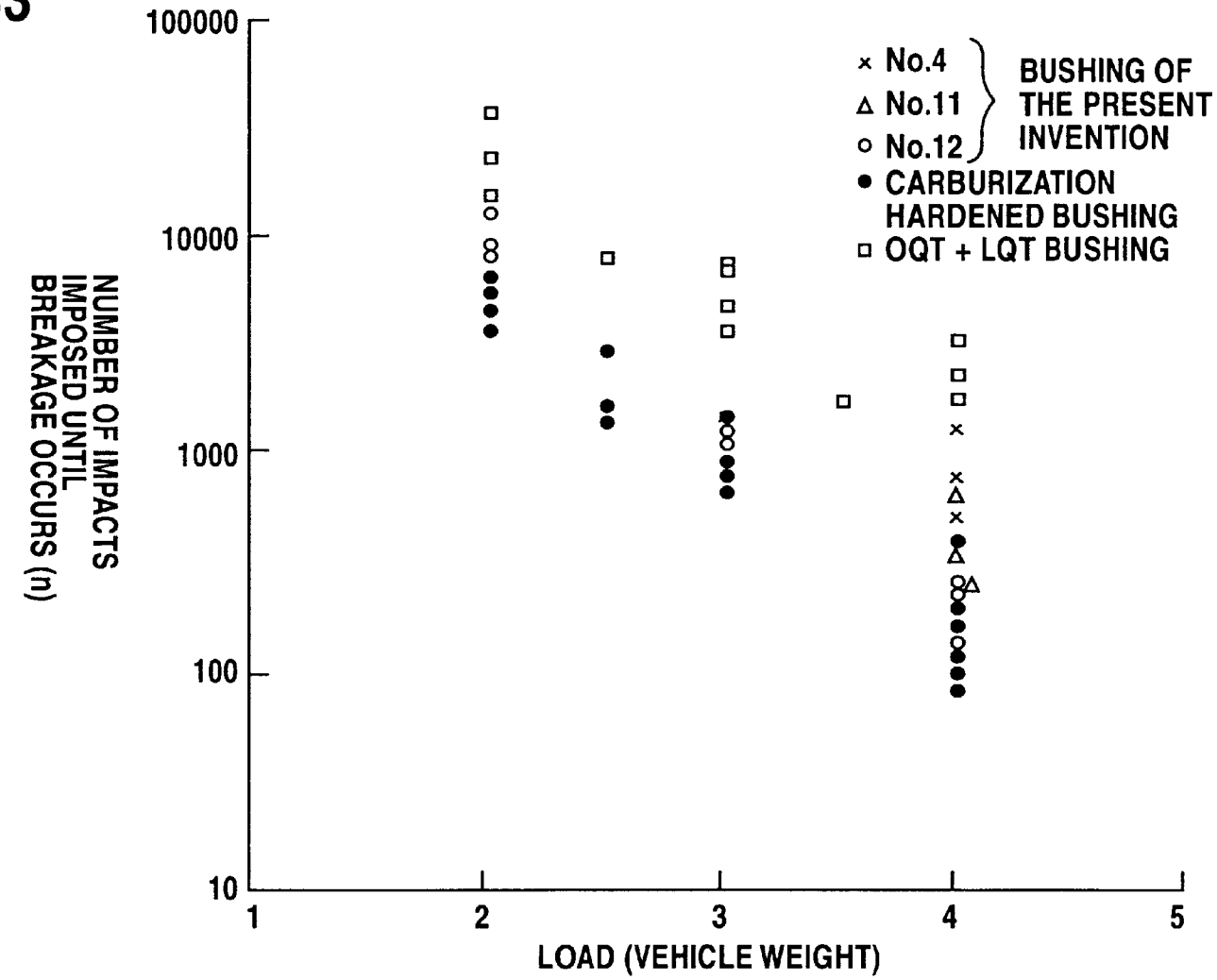
FIG. 33 is a graph showing the results of impact fatigue tests.
Figure 34C:
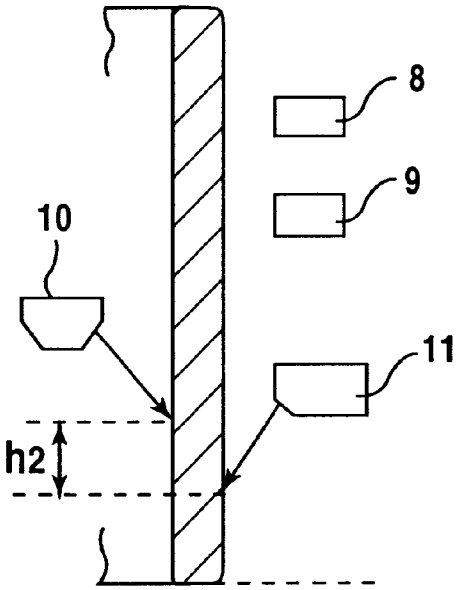
FIGS. 34(*a*) to 34(*f*) show the steps of the scan induction hardening in Example 4.
Figure 34B:
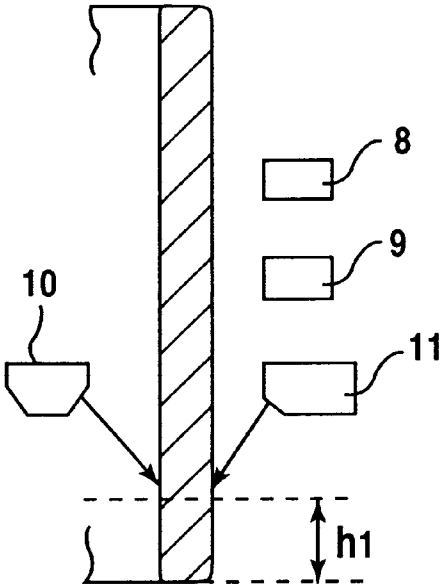
Figure 34A:
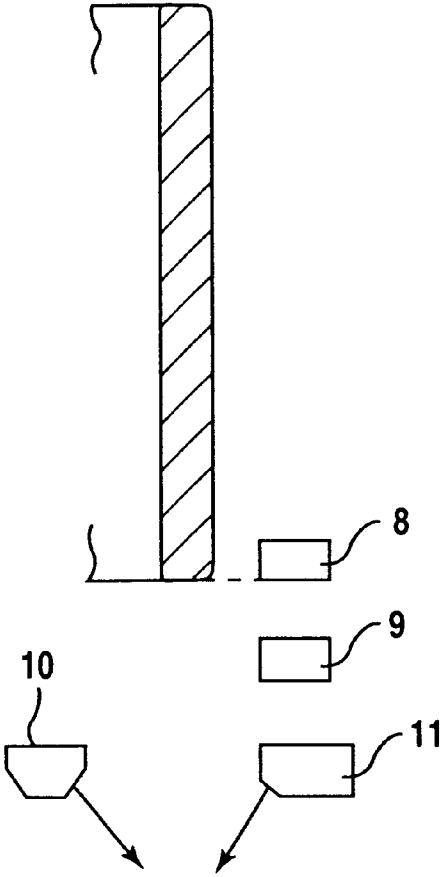
Figure 34F:
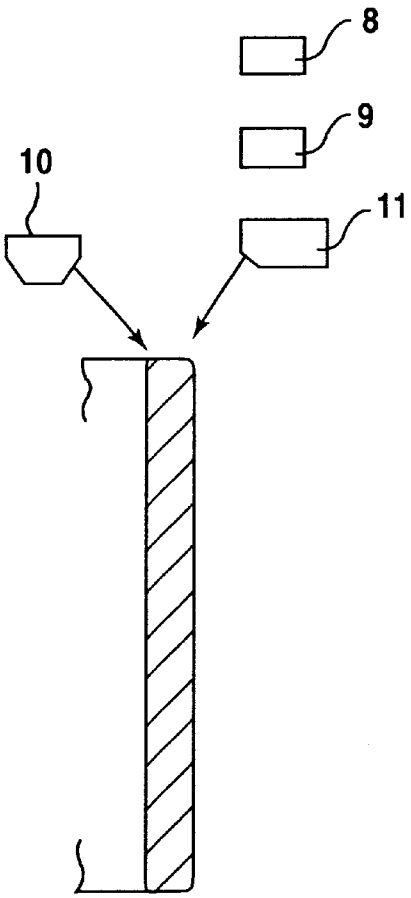
Figure 34E:
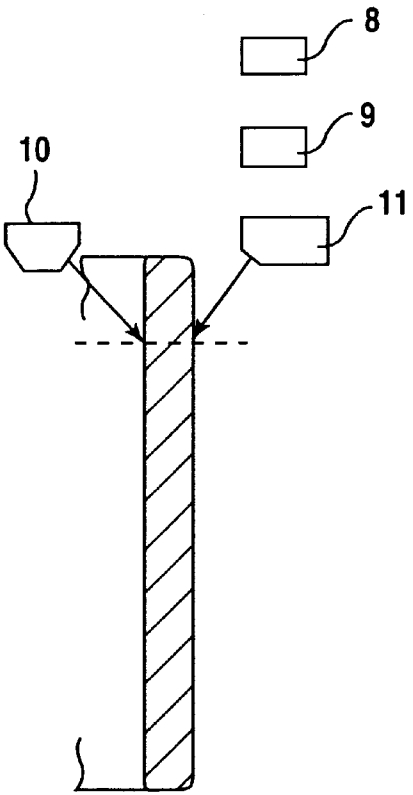
Figure 34D:
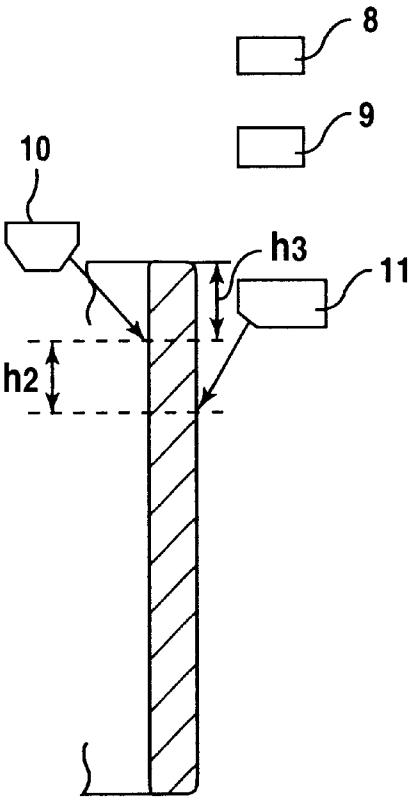

The results of the measurements are shown in FIG. 33. As seen from this figure, the bushings prepared according to the invention are improved in impact strength over the conventional carburized bushings. This is presumably attributable to the facts that a grain boundary layer or imperfectly hardened layer exists in the inner circumferential surface of the conventional carburized bushings and that the carburized bushings have higher surface carbon content (about 0.8 wt %) and higher surface hardness. This means that the impact fatigue strength of the bushings of the invention can be increased by adjusting the hardness of the inner circumferential surface to increase toughness. It is conventionally known that when the surface hardness Hv of the inner circumferential surface is 500 to 600, the optimum strength can be obtained. For example, when the bushing of the invention has a surface hardness Hv of 400, it has higher strength than the conventional carburized bushings, but distortion occurred at the inner circumference after the test. This distortion is a cause of interference with crawler belt pins. Therefore, the hardness for the invention is preferably 450 or more. The upper limit of hardness Hv for the invention is not particularly specified by the comparison with the conventional carburized bushing, but may be as high as the surface hardness of the carburized bushing (Hv=up to 750). However, in order to achieve the optimum impact strength properties, the hardness Hv of the inner circumferential surface of the invention is preferably limited to about 650. It is important particularly for the bushing having the composition No. 12 and manufactured according to the invention in which cementite grains are dispersed, that cementite does not precipitate in the prior austenite grain boundary and that the soft layer formed in the core is mostly composed of a bainitic structure having granular cementite dispersed therein.

EXAMPLE 4

In Example 4, scan hardening is carried out along the bushing from the bottom to the top, using the scan induction hardening system (shown in FIG. 5) employed in Example 3. Since the heat input at the lower end of the bushing in the initial stage is small, the high frequency coils 8, 9 are interrupted for a specified length of time. When scan quenching is carried out by use of the inner circumferential surface cooling nozzle 10 and the outer circumferential surface cooling nozzle 11, the level at which water jetted from the nozzle 10 strikes and the level at which water jetted from the nozzle 11 strikes are made to be equal to each other within specified zones close to the lower and upper end faces, respectively, of the bushing. With this arrangement, the bushing is hardened through its entire cross section at the lower and upper ends thereof.

Reference is now made to FIG. 34 to describe the steps of the hardening operation according to Example 4 in detail.

In the initial stage shown in FIG. 34(*a*), the high frequency coils 8, 9 are stationary and heating is carried out until the inner circumferential surface of the bushing reaches the austenitic temperature range. Then, the high frequency coils 8, 9 are moved upward at constant speed, being followed by the inner and outer circumferential surface cooling nozzles 10, 11. At this stage, the level at which the coolant jetted from the nozzle 10 strikes upon the bushing surface and the level at which the coolant jetted from the nozzle 11 strikes upon the bushing surface are equal to each other. At that time, the inner circumferential surface and outer circumferential surface are simultaneously cooled within the region having a specified height $h_1$ from the lower end of the bushing, as shown in FIG. 34(*b*). Since the inner and outer circumferential surfaces are simultaneously cooled in the lower region of the bushing, the bushing can be hardened through its cross section in this region, if the steel of the bushing has enough hardenability.

As shown in FIG. 34(*c*), after the striking level of the coolants from both nozzles 10, 11 has reached a specified level, the upward movement of the outer circumferential surface cooling nozzle 11 is stopped, while the inner circumferential surface cooling nozzle 10 being continuously moved upward at a specified speed in synchronous relation with the high frequency coils 8, 9. At the time when the difference between the striking level of the coolant from the nozzle 10 and the striking level of the coolant from the nozzle 11 becomes equal to a specified distance $h_2$, the nozzle 11 is moved upward synchronously with the nozzle 10 at the same speed as that of the nozzle 10. In this way, the cooling from the inner circumferential surface advances by the time that is obtained by dividing the level difference $h_2$ by the moving speed of the nozzles 10, 11. Thanks to this advance cooling from the inner circumferential surface, the temperature of the bushing at the center in its cross section decreases to such a temperature range in which hardening does not occur, and as a result, an imperfectly hardened layer is created inside the wall of the bushing.

At the time when the striking level of the coolant from the nozzle 10 has reached a position having a specified distance $h_3$ (=$h_1$) from the upper end of the bushing, the nozzle 10 is stopped, as shown in FIG. 34(*d*). Thereafter, the nozzle 11 is continuously moved upward. When the striking level of the coolant from the nozzle 10 and the striking level of the coolant from the nozzle 11 become equal to each other as shown in FIG. 34(*e*), the nozzles 10, 11 are synchronously moved toward the upper end of the bushing while keeping the coolant striking levels of both nozzles the same, as shown in FIG. 34(*f*). When reached the upper end, the nozzles are stopped, while cooling is continued until the bushing is completely cooled.

Figure 35C:
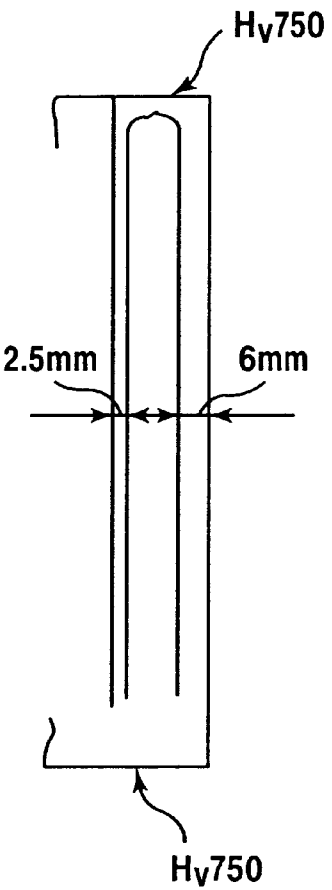
FIGS. 35(*a*) to 35(*c*) show three entire hardened pattern when a 15 mm-thick crawler belt bushing for bulldozers is hardened. Specifically, FIG. 35(*a*) is the pattern obtained by carburization hardening.
Figure 35B:
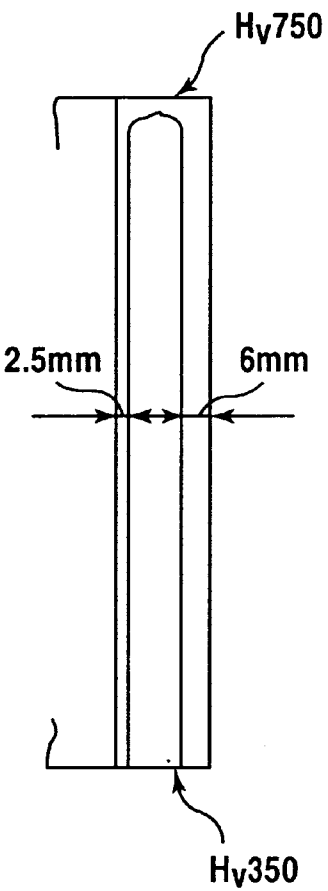
Figure 35A:
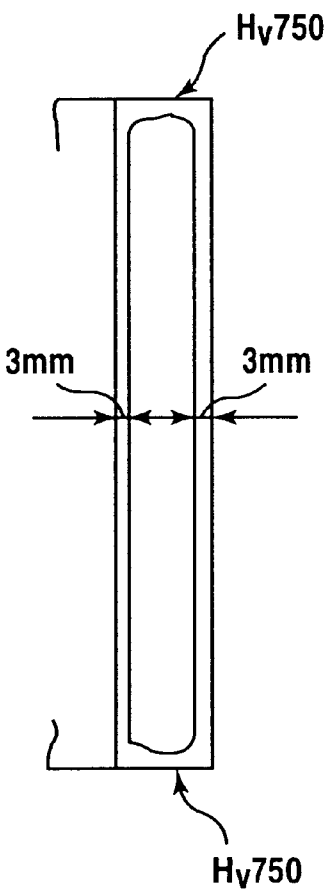
Figure 36:
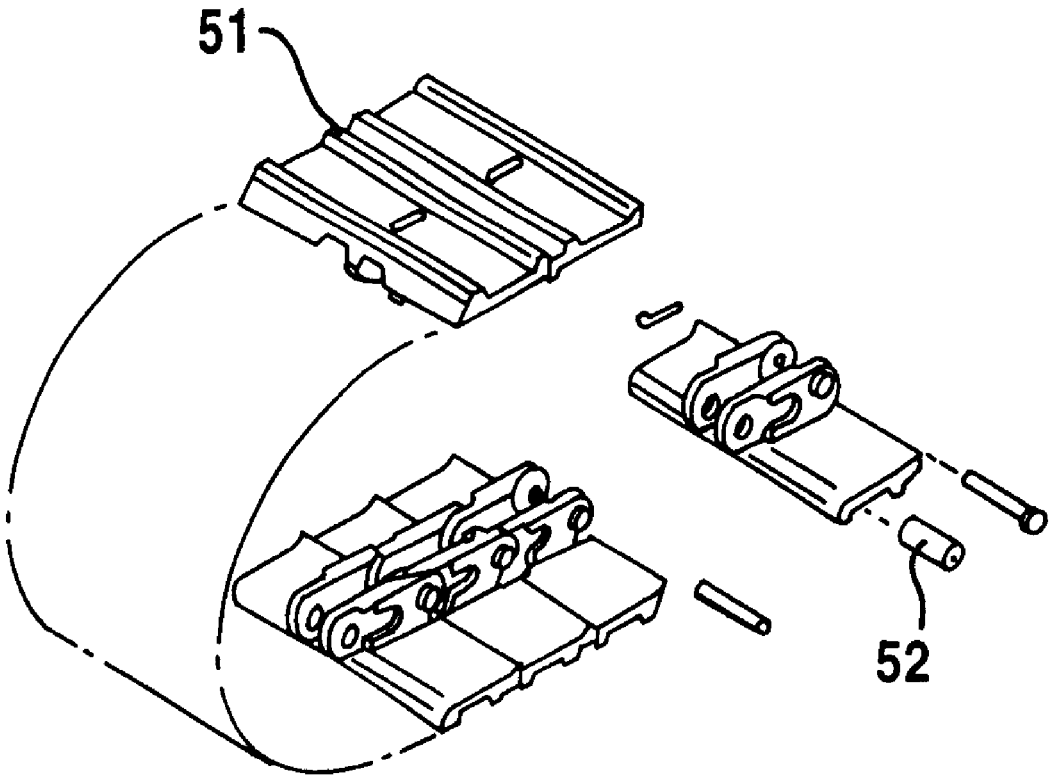
FIG. 36 is an exploded perspective view of a crawler belt bushing.
Figure 37A:
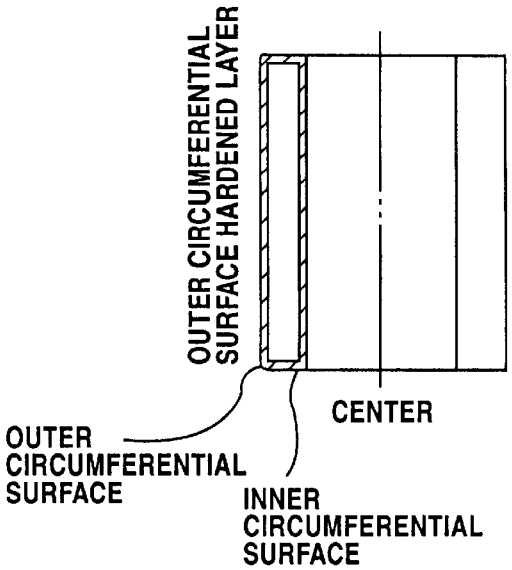
FIGS. 37(*a*), 37(*b*) and 37(*c*) are diagrams showing typical hardening patterns for bushings produced by the conventional methods and FIG. 37(*d*) is a graph showing the distributions of hardness in the cross sections of these bushings.
Figure 37B:
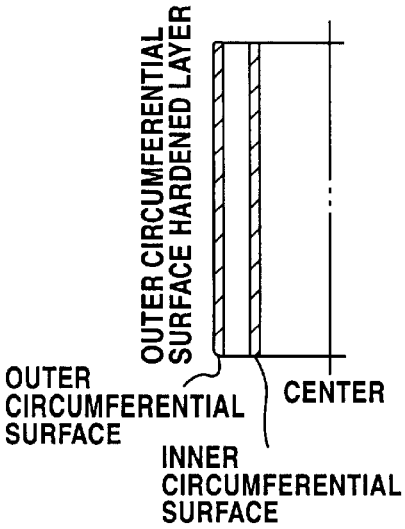
Figure 37C:
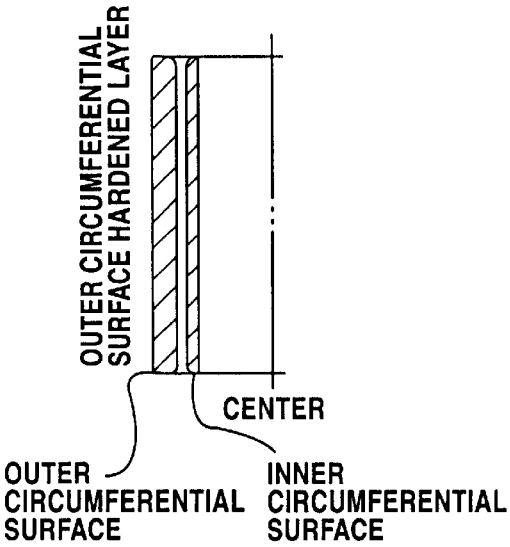
Figure 37D:
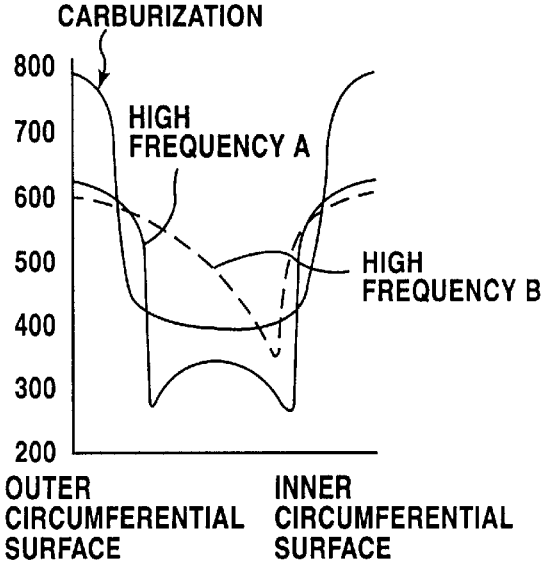

FIG. 35 shows three entire hardened patterns when a 15 mm-thick crawler belt bushing for bulldozers is hardened. Specifically, (a) is the pattern obtained by carburization hardening; (b) is the pattern obtained by the time difference hardening incorporating induction heating, with a constant positional relationship between the cooling nozzles; and (c) is the pattern obtained by the hardening process of Example 4. The bushings used herein are made of a S55C steel having a DI value (indicating the hardenability of steel) of 1.5, and the time difference (i.e., lead time) between the inner circumferential surface cooling and the outer circumferential surface cooling is 6 seconds. As seen from FIG. 35, in the bushing treated by the hardening process of Example 4, hardened layers are formed at both ends, and the depth of the outer circumference is greater than the depth of the inner circumference. In addition, the depth of the outer circumference of Example 4 is greater than that of the carburized bushing. In contrast with this, the bushing (b) treated by the time difference hardening with a constant nozzle positional relationship has a hardened layer at the upper end face only, with the internal imperfectly hardened layer extending throughout the lower end of the bushing.

What is claimed is:

1. A crawler belt bushing producing method comprising the steps of: providing a crawler belt bushing made of a medium or high carbon steel or a medium or high carbon low alloy steel; heating said crawler belt bushing to a quenching temperature or more to provide a heated crawler belt bushing by use of a hardening system; providing the hardening system which can independently start outer circumferential surface cooling and inner circumferential surface cooling; cooling the heated crawler belt bushing from either one of its outer circumferential surface and inner circumferential surface and then cooling from the other circumferential surface so that the heated crawler belt bushing is hardened through its entire thickness to provide a hardened crawler belt bushing; and then tempering the hardened crawler belt bushing to provide a tempered crawler belt bushing.

2. A crawler belt bushing producing method according to claim 1, wherein said hardening system has a partition between a cooling medium for the inner circumferential surface and a cooling medium for the outer circumferential surface, taking into account the flows of the cooling media, such that the cooling media do not interfere with each other during cooling of the bushing.

3. A crawler belt bushing producing method according to claim 1, wherein after the bushing is substantially uniformly and entirely heated to a quenching temperature by furnace heating and/or induction heating, cooling the bushing from either one of the inner circumferential surface and outer circumferential surface, and one or more seconds later, cooling the bushing from the other circumferential surface.

4. A crawler belt bushing producing method according to claim 1, wherein the heating is scan induction heating in the axial direction of the bushing from either one of the inner circumferential surface and outer circumferential surface, cooling of the heated surface is with a spray and is started from either one of the inner circumferential surface and outer circumferential surface, and one or more seconds later, cooling of the heated surface with the spray is started from the other circumferential surface.

5. A crawler belt bushing producing method according to claim 1, wherein said tempering process is carried out at 140 to 350° C.

6. A crawler belt bushing producing method according to claim 1, wherein the hardness of the inner circumferential surface is adjusted to Vickers hardness $H_v$450 to 600 by said tempering process.

7. A crawler belt bushing producing method according to claim 6, wherein said adjustment of the hardness of the inner circumferential surface is carried out by stopping the induction tempering from the inner circumferential surface and/or the cooling from the inner circumferential surface during quenching operation, earlier than the cooling from the outer circumferential surface, thereby allowing self-tempering of the inner circumferential surface.

8. A crawler belt bushing producing method comprising the steps of heating a crawler belt bushing made of steel to a quenching temperature, then at least one of:

(a) increasing the cooling rate of the outer circumferential surface of the bushing by first cooling the bushing with a cooling media from its inner circumferential surface in order to reduce heat capacity at the core of the bushing and by second cooling the bushing with a cooling media from its outer circumferential surface starting at a certain time after the first cooling and (b) increasing the cooling rate of the outer circumferential surface of the bushing by first cooling the bushing with a cooling media from its inner circumferential surface in order to partially make the core of the bushing unhardenable by utilizing the mass effect of the wall of the bushing and by second cooling the bushing with a cooling media from its outer circumferential surface starting at a certain time after the first cooling, whereby a soft layer is formed within the core of the bushing at a cross-sectional position closer to the inner circumferential surface and the hardened depth of the outer circumferential surface is made to be greater than the hardened depth of the inner circumferential surface, said processes (a) and (b) being carried out within one cycle of quenching operation, using a hardening system adapted to perform inner circumferential surface cooling and outer circumferential surface cooling.

9. A crawler belt bushing producing method according to claim 8, wherein said hardening system has a partition between a cooling medium for the inner circumferential surface and a cooling medium for the outer circumferential surface, taking into account the flows of the cooling media, such that the cooling medium for the inner circumferential surface does not interfere with the outer circumferential surface during the first cooling from the inner circumferential surface.

10. A crawler belt bushing producing method according to claim 9, wherein said cooling media are quenching oil, water, water-soluble quenching liquid or water fog and wherein said cooling from the inner circumferential surface is jet cooling which uses a spray for substantially uniformly cooling the inner circumferential surface.

11. A crawler belt bushing producing method according to claim 8, wherein the bushing is substantially uniformly and entirely heated to a quenching temperature by furnace heating and/or induction heating, then quenching is carried out using said hardening system.

12. A crawler belt bushing producing method according to claim 8, wherein the heating is scan induction heating in the axial direction of the bushing carried out from either one of the inner and outer circumferential surfaces, the quenching is scan quenching carried out by first cooling the bushing from the inner circumferential surface and then cooling the bushing from the outer circumferential surface, under the condition that the temperatures of the inner and outer circumferential surfaces are quenching temperatures equal to or higher than the transformation temperatures of A1, A3 and/or Acm.

13. A crawler belt bushing producing method according to claim 12, wherein said scan quenching during the induction heating is carried out such that the bushing, an induction heating coil, an inner circumferential surface cooling nozzle and an outer circumferential surface cooling nozzle are relatively moved in the axial direction of the bushing and the bushing is rotated substantially about its central axis.

14. A crawler belt bushing producing method according to claim 12 or 13, wherein cooling from the inner circumferential surface and cooling from the outer circumferential surface are carried out at substantially the same time at least within specified regions close to an upper end face and lower end face, respectively, of the bushing, so that the upper and lower end faces are through hardened.

15. A crawler belt bushing producing method wherein the bushing hardened by the bushing producing method set forth in claim 8 is tempered at between 140° C. and 350° C.

16. A crawler belt bushing producing method according to claim 8, wherein said bushing is made of a steel having a carbon content equal to those of medium carbon steels and/or eutectoid steels, which is 0.35 wt % or more, and having an alloy content within the range of DI values with which the bushing is through hardened by simultaneous cooling of the inner and outer circumferential surfaces and with which the hardened depth obtained by cooling from the inner circumferential surface only is about one half the thickness of the bushing.

17. A crawler belt bushing producing method further comprising stopping the induction tempering from the inner circumferential surface of the bushing hardened by the bushing producing method set forth in claim 8 and/or the cooling from the inner circumferential surface during quenching operation, earlier than the cooling from the outer circumferential surface, thereby allowing self-tempering of the inner circumferential surface so as to have a surface hardness of Vickers hardness Hv 450 to 650.

18. A crawler belt bushing producing method comprising the steps of induction heating a crawler belt bushing made of steel from its outer circumferential surface such that at least the temperature of an inner circumferential surface of the bushing is raised to a quenching temperature, then carrying out a series of quenching operations comprising:

(a) firstly cooling the bushing from the inner circumferential surface;

(b) cooling the bushing from the inner circumferential surface while heating the bushing from the outer circumferential surface; and (c) cooling the bushing from the outer circumferential surface, so as to form quench hardened layers which extend toward the wall core of the bushing from the outer circumferential surface and from the inner circumferential surface respectively and form a soft layer between said quench hardened layers.

19. A crawler belt bushing producing method comprising the steps of heating a crawler belt bushing made of steel from its outer circumferential surface by scan induction heating in the axial direction of the bushing, by using at least two vertically aligned, induction coils, (a) raising the temperature of the inner circumferential surface of the bushing to a quenching temperature equal to the transformation temperatures of A1, A3 and/or Acm or more;

(b) partially heating the bushing from the outer circumferential surface by the induction coils while carrying out first cooling from the inner circumferential surface; and (c) then cooling the bushing from the outer circumferential surface;

whereby the inner and outer circumferential surfaces are quench hardened so as to be substantially martensitic, said processes (a), (b) and (c) being carried out at a certain position of the bushing.

20. A crawler belt bushing producing method according to claim 19, wherein cooling from the inner circumferential surface and cooling from the outer circumferential surface are carried out at substantially the same time at least within specified regions close to an upper end face and lower end face, respectively, of the bushing, so that the upper and lower end faces are through hardened.

21. A crawler belt bushing producing method according to claim 18 or 19, using a hardening system having a partition between a cooling medium for the inner circumferential surface and a cooling medium for the outer circumferential surface, taking into account the flows of the cooling media, such that the cooling medium for the inner circumferential surface does not interfere with the outer circumferential surface during the first cooling from the inner circumferential surface.

22. A crawler belt bushing producing method according to claim 19, wherein said scan quenching by induction heating is carried out such that the bushing, an induction heating coil, an inner circumferential surface cooling nozzle and an outer circumferential surface cooling nozzle are relatively moved and the bushing is rotated substantially about its central axis.

23. A crawler belt bushing producing method according to claim 21, wherein said cooling media are quenching oil, water, water-soluble quenching liquid or water fog and wherein said cooling from the inner circumferential surface is jet cooling which uses a spray for substantially uniformly cooling the inner circumferential surface.

24. A crawler belt bushing producing method, wherein the bushing hardened by the bushing producing method according to claim 18 or 19 is tempered at between 140° C. and 350° C.

25. A crawler belt bushing producing method further comprising stopping the induction tempering from the inner circumferential surface of the bushing hardened by the bushing producing method set forth in claim 18 and/or the cooling from the inner circumferential surface during quenching operation, earlier than the cooling from the outer circumferential surface, thereby allowing self-tempering of the inner circumferential surface so as to have a surface hardness of Vickers hardness Hv 450 to 650.

* * * * *